US008657515B2

(12) United States Patent
Hoadley et al.

(10) Patent No.: US 8,657,515 B2
(45) Date of Patent: Feb. 25, 2014

(54) CLEANING KIT INCLUDING DUSTER AND SPRAY

(75) Inventors: David A. Hoadley, Racine, WI (US); John W. Moderwell, Libertyville, IL (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 13/115,360

(22) Filed: May 25, 2011

(65) Prior Publication Data

US 2011/0226638 A1 Sep. 22, 2011

Related U.S. Application Data

(60) Division of application No. 11/450,839, filed on Jun. 9, 2006, now Pat. No. 7,976,235, which is a continuation-in-part of application No. 11/351,756, filed on Feb. 10, 2006, now abandoned, and a continuation-in-part of application No. 11/045,204, filed on Jan. 28, 2005, now abandoned.

(51) Int. Cl.
*A47L 1/08* (2006.01)

(52) U.S. Cl.
USPC ..... 401/138

(58) Field of Classification Search
USPC ..... 401/136–140
See application file for complete search history.

(56) References Cited

U.S. PATENT DOCUMENTS

| | | | |
|---|---|---|---|
| 781,814 | A | 2/1905 | D'Ossone |
| 782,669 | A | 2/1905 | Lea |
| 823,725 | A | 6/1906 | Hayden |
| 1,250,150 | A | 12/1917 | DuBois |
| 1,313,184 | A | 8/1919 | Hayden |
| 1,437,145 | A | 11/1922 | Johnson |
| 1,542,108 | A | 6/1925 | Taylor |
| 1,637,595 | A | 8/1927 | Sturgis |
| 1,722,162 | A | 7/1929 | Teetsell |
| 1,804,415 | A | 5/1931 | Hales |
| 1,978,748 | A | 10/1934 | Gregory |
| 2,037,135 | A | 4/1936 | Johnson et al. |
| 2,047,199 | A | 7/1936 | Gewalt |
| 2,068,162 | A | 1/1937 | Borchers |
| 2,151,425 | A | 3/1939 | Gregory |
| 2,185,873 | A | 1/1940 | Underhill |
| 2,262,888 | A | 11/1941 | Dodge |
| 2,679,064 | A | 5/1954 | Palma, Jr. et al. |
| 2,755,498 | A | 7/1956 | Park |
| 2,808,605 | A | 10/1957 | Licata |
| 2,816,313 | A | 12/1957 | Beck et al. |
| 2,862,217 | A | 12/1958 | Small et al. |

(Continued)

FOREIGN PATENT DOCUMENTS

| | | | |
|---|---|---|---|
| CA | 2384357 | A1 | 3/2002 |
| CA | 2492582 | A1 | 1/2004 |

(Continued)

OTHER PUBLICATIONS

PCT/US2007/013269 International Search Report and Written Opinion dated Feb. 26, 2008.

*Primary Examiner* — Huyen Le

(57) ABSTRACT

A cleaning pad (28) is disclosed. The cleaning pad (28) includes a base sheet (202) bonded to a fiber mat (203) and exhibits improved debris retention.

15 Claims, 14 Drawing Sheets

(56) References Cited

U.S. PATENT DOCUMENTS 2,877,482 A 3/1959 Roy
2,935,754 A 5/1960 Abdo
3,066,344 A 12/1962 Garcia et al.
3,196,475 A 7/1965 Brown
3,221,356 A 12/1965 Schirmer
3,406,694 A 10/1968 Odence
3,505,155 A 4/1970 Balch et al.
3,525,113 A 8/1970 Leland
3,528,076 A 9/1970 Anderson
3,605,882 A 9/1971 Thomas
3,655,501 A 4/1972 Tesch
3,687,797 A 8/1972 Wideman
3,760,450 A 9/1973 Griffin et al.
3,822,435 A 7/1974 Moss
3,965,518 A 6/1976 Muoio
3,979,163 A 9/1976 Beard
4,010,511 A 3/1977 Komatsu
4,013,369 A 3/1977 Turek
4,018,646 A 4/1977 Ruffo et al.
4,041,203 A 8/1977 Brock et al.
4,114,224 A 9/1978 Disko
4,196,245 A 3/1981 Stanley
4,298,649 A 11/1981 Meitner
4,309,469 A 1/1982 Varona
4,313,774 A 2/1982 Arthur
4,364,144 A 12/1982 Moss et al.
4,376,147 A 3/1983 Byrne et al.
4,377,615 A 3/1983 Suzuki et al.
D268,967 S 5/1983 Sami
D268,968 S 5/1983 Sami
4,426,417 A 1/1984 Meitner et al.
4,432,472 A 2/1984 Lemm
4,436,780 A 3/1984 Hotchkiss et al.
4,469,734 A 9/1984 Minto et al.
4,469,735 A 9/1984 Trokhan
4,473,918 A 10/1984 Moss et al.
4,487,795 A 12/1984 Yasuda et al.
4,510,640 A 4/1985 Omori
4,546,029 A 10/1985 Cancio et al.
4,601,938 A 7/1986 Deacon et al.
4,609,518 A 9/1986 Curro et al.
4,623,575 A 11/1986 Brooks et al.
4,685,167 A 8/1987 Murray
4,705,420 A 11/1987 Bokmiller et al.
4,710,185 A 12/1987 Snevd, Jr. et al.
4,713,274 A 12/1987 Minor
4,776,716 A 10/1988 Huang
4,788,735 A 12/1988 Fuk Fan
4,802,782 A 2/1989 Scalf
4,806,037 A 2/1989 Berglund
4,829,622 A 5/1989 O'Sullivan
4,859,519 A 8/1989 Cabe, Jr. et al.
4,906,513 A 3/1990 Kebbell et al.
4,926,515 A 5/1990 Lynn et al.
4,954,001 A 9/1990 Billat
4,983,060 A 1/1991 Steinbach
4,991,362 A 2/1991 Heyer et al.
4,995,133 A 2/1991 Newell et al.
5,039,431 A 8/1991 Johnson et al.
5,062,729 A 11/1991 Yamamoto
5,071,489 A 12/1991 Silvenis et al.
5,141,348 A 8/1992 'tartt
5,143,774 A 9/1992 Cancio et al.
5,229,191 A 7/1993 Austin
5,427,838 A 6/1995 Yamamoto et al.
5,429,854 A 7/1995 Currie et al.
5,452,491 A 9/1995 Thompson
5,466,318 A 11/1995 Bjork
5,477,582 A 12/1995 Yamashita
5,525,397 A 6/1996 Shizuno et al.
5,572,763 A 11/1996 Equchi
5,573,719 A 11/1996 Fitting
5,603,139 A 2/1997 Alazet
5,613,263 A 3/1997 Nolte
5,715,560 A 2/1998 Banicki
D391,711 S 3/1998 Hanaoka et al.
5,722,966 A 3/1998 Christon et al.
5,735,620 A 4/1998 Ford
5,769,324 A 6/1998 Lenhart
5,779,155 A 7/1998 Schennum et al.
5,815,878 A 10/1998 Murakami et al.
5,839,150 A 11/1998 Miyaoka
5,842,488 A 12/1998 Belleau et al.
5,845,361 A 12/1998 Murakami et al.
5,865,551 A 2/1999 Lalli et al.
5,888,006 A 3/1999 Ping et al.
5,895,504 A 4/1999 Sramek et al.
5,908,255 A 6/1999 Branch
5,953,784 A 9/1999 Suzuki et al.
5,958,555 A 9/1999 Takeuchi et al.
5,960,508 A 10/1999 Holt et al.
5,962,112 A 10/1999 Haynes et al.
5,980,673 A 11/1999 Takeuchi et al.
6,013,349 A 1/2000 Takeuchi et al.
6,047,435 A 4/2000 Suzuki et al.
6,054,202 A 4/2000 Takeuchi et al.
6,119,298 A 9/2000 Kenmochi et al.
6,142,750 A 11/2000 Benecke
6,143,393 A 11/2000 Abe et al.
6,202,246 B1 3/2001 Boucher
6,202,250 B1 3/2001 Kenmochi et al.
6,206,058 B1 3/2001 Nagel et al.
6,241,835 B1 6/2001 Abe et al.
6,245,413 B1 6/2001 Kenmochi et al.
6,298,517 B1 10/2001 McKay
6,305,046 B1 10/2001 Kingry et al.
6,309,731 B1 10/2001 Takeuchi et al.
6,315,478 B1 11/2001 Atkins
6,329,308 B1 12/2001 Kenmochi et al.
6,361,638 B2 3/2002 Takai et al.
6,405,403 B1 6/2002 McKay
6,406,206 B1 6/2002 Girardot et al.
6,506,472 B1 1/2003 Tanaka et al.
6,513,184 B1 2/2003 Brown et al.
6,540,424 B1 4/2003 Hall et al.
6,551,001 B2 4/2003 Aberegg et al.
6,554,937 B1 4/2003 Kenmochi et al.
6,557,178 B1 5/2003 Hoover
6,572,602 B2 6/2003 Furuya et al.
6,651,290 B2 11/2003 Kingry et al.
6,669,391 B2 * 12/2003 Policicchio et al. ..... 401/270
6,672,313 B2 1/2004 Battaglia et al.
6,681,434 B2 1/2004 Smith
6,687,942 B1 2/2004 Pember
6,687,944 B2 2/2004 Young
6,716,514 B2 4/2004 Nissing
6,722,806 B2 4/2004 Kunkler et al.
6,742,717 B2 6/2004 Aberegg et al.
6,742,951 B2 6/2004 Schultz et al.
6,750,187 B2 6/2004 Alam et al.
6,758,412 B2 7/2004 Aberegg et al.
6,777,064 B1 8/2004 Brown et al.
6,794,351 B2 9/2004 Shick et al.
6,797,400 B2 9/2004 Weuthen et al.
6,807,702 B2 10/2004 Keck et al.
6,810,554 B2 11/2004 McKay
6,813,801 B2 11/2004 Tanaka et al.
6,815,502 B1 11/2004 Lang et al.
6,823,555 B2 * 11/2004 Warren ..... 15/176.2
6,828,014 B2 12/2004 Branham et al.
6,828,290 B1 12/2004 Evers et al.
6,835,678 B2 12/2004 Jackson et al.
6,851,881 B2 2/2005 Slaboden
6,855,790 B2 2/2005 Chang et al.
6,887,807 B1 5/2005 Matsushita et al.
6,953,299 B2 10/2005 Wang et al.
6,960,042 B1 11/2005 Hsiao
6,968,591 B2 * 11/2005 Tanaka ..... 15/229.1
6,978,509 B2 12/2005 Lin
2002/0132098 A1 9/2002 Miyazawa et al.
2002/0147122 A1 10/2002 Shick et al.
2002/0148061 A1 10/2002 Tanaka et al.
2003/0000039 A1 1/2003 Borcherds
2003/0074756 A1 4/2003 Policicchio et al.

(56) References Cited

U.S. PATENT DOCUMENTS

| | | | | |
|---|---|---|---|---|
| 2003/0106568 | A1 | 6/2003 | Keck et al. | |
| 2003/0126710 | A1 | 7/2003 | Policicchio et al. | |
| 2003/0159223 | A1 | 8/2003 | Plankenhorn | |
| 2003/0180083 | A1 | 9/2003 | Hall et al. | |
| 2003/0182751 | A1 | 10/2003 | White | |
| 2003/0194259 | A1 | 10/2003 | Kunkler et al. | |
| 2003/0200991 | A1 | 10/2003 | Keck et al. | |
| 2003/0211802 | A1 | 11/2003 | Keck et al. | |
| 2003/0233718 | A1 | 12/2003 | Heathcock et al. | |
| 2003/0235463 | A1 | 12/2003 | Neumann et al. | |
| 2004/0016074 | A1 | 1/2004 | Smith | |
| 2004/0022575 | A1 | 2/2004 | Hall et al. | |
| 2004/0034956 | A1 | 2/2004 | Tanaka et al. | |
| 2004/0086320 | A1 | 5/2004 | Policicchio et al. | |
| 2004/0141797 | A1 | 7/2004 | Garabedian et al. | |
| 2004/0141798 | A1 | 7/2004 | Garabedian et al. | |
| 2004/0178224 | A1 | 9/2004 | Fahy et al. | |
| 2004/0184867 | A1 | 9/2004 | Wang et al. | |
| 2004/0216771 | A1 | 11/2004 | Hall et al. | |
| 2004/0226123 | A1 | 11/2004 | Policicchio et al. | |
| 2005/0000050 | A1 | 1/2005 | Galvin et al. | |
| 2005/0004546 | A1 | 1/2005 | Mizutani et al. | |
| 2005/0016035 | A1 | 1/2005 | Kobavashi et al. | |
| 2005/0039285 | A1 | 2/2005 | Tanaka et al. | |
| 2005/0085407 | A1 | 4/2005 | Oldenhove et al. | |
| 2005/0097691 | A1 | 5/2005 | Tsuchiva et al. | |
| 2005/0097695 | A1 | 5/2005 | Tanaka et al. | |
| 2005/0097696 | A1 | 5/2005 | Tanaka et al. | |
| 2005/0102781 | A1* | 5/2005 | Tsuchiya et al. | 15/147.2 |
| 2005/0132521 | A1 | 6/2005 | Tanaka et al. | |
| 2005/0136775 | A1 | 6/2005 | Tanaka | |
| 2005/0137555 | A1 | 6/2005 | Mizutani et al. | |
| 2005/0144747 | A1 | 7/2005 | Juan | |
| 2005/0177967 | A1 | 8/2005 | Tanaka et al. | |
| 2005/0188490 | A1 | 9/2005 | Tanaka et al. | |
| 2005/0193513 | A1 | 9/2005 | Tanaka et al. | |
| 2005/0198760 | A1 | 9/2005 | Tanaka et al. | |
| 2005/0202190 | A1 | 9/2005 | Ledger et al. | |
| 2005/0221070 | A1 | 10/2005 | Bando et al. | |
| 2006/0123575 | A1* | 6/2006 | Maloney et al. | 15/144.1 |
| 2006/0228161 | A1 | 10/2006 | Hoadley et al. | |

FOREIGN PATENT DOCUMENTS

| | | | |
|---|---|---|---|
| CH | 152201 | | 4/1932 |
| DE | 279352 | | 10/1913 |
| DE | 827344 | | 1/1952 |
| DE | 1771672 | | 2/1972 |
| DE | 4330357 | A1 | 2/1995 |
| DE | 29516181 | U1 | 10/1995 |
| DE | 29701349 | U1 | 1/1997 |
| DE | 19630522 | A1 | 2/1998 |
| EP | 0097036 | A2 | 12/1983 |
| EP | 0399495 | A1 | 11/1990 |
| EP | 0468201 | A1 | 1/1992 |
| EP | 0739600 | A1 | 10/1996 |
| EP | 0774229 | A2 | 5/1997 |
| EP | 0777997 | A2 | 6/1997 |
| EP | 0848927 | A1 | 6/1998 |
| EP | 0863240 | A1 | 9/1998 |
| EP | 0864289 | A2 | 9/1998 |
| EP | 0943425 | A1 | 9/1999 |
| EP | 0945251 | A1 | 9/1999 |
| EP | 0959164 | A1 | 11/1999 |
| EP | 0968677 | A2 | 1/2000 |
| EP | 0872206 | B1 | 7/2000 |
| EP | 1095763 | A1 | 5/2001 |
| EP | 1147734 | A2 | 10/2001 |
| EP | 0986322 | B1 | 12/2001 |
| EP | 0968677 | A3 | 1/2002 |
| EP | 1021121 | B1 | 6/2002 |
| EP | 1211342 | A1 | 6/2002 |
| EP | 1212972 | A2 | 6/2002 |
| EP | 1222915 | A2 | 7/2002 |
| EP | 0865755 | B1 | 5/2003 |
| EP | 1314391 | A1 | 5/2003 |
| EP | 0923902 | B1 | 7/2003 |
| EP | 0983014 | B1 | 12/2003 |
| EP | 0841879 | B1 | 7/2004 |
| EP | 1213230 | B1 | 1/2005 |
| EP | 1498028 | B1 | 1/2005 |
| EP | 1250220 | B1 | 4/2005 |
| EP | 1523919 | A1 | 4/2005 |
| EP | 1523920 | A1 | 4/2005 |
| EP | 1523921 | A2 | 4/2005 |
| EP | 1523922 | A2 | 4/2005 |
| EP | 1523923 | A2 | 4/2005 |
| EP | 1523924 | A2 | 4/2005 |
| EP | 1523925 | A2 | 4/2005 |
| EP | 1537819 | A2 | 6/2005 |
| EP | 1547513 | A2 | 6/2005 |
| EP | 155395 | A2 | 7/2005 |
| EP | 1302146 | B1 | 7/2005 |
| EP | 1552890 | A1 | 7/2005 |
| EP | 1555967 | A2 | 7/2005 |
| EP | 1566135 | A1 | 8/2005 |
| EP | 1591053 | A1 | 11/2005 |
| EP | 15910575 | A1 | 11/2005 |
| GB | 2369560 | A | 6/2002 |
| GB | 2395680 | A | 6/2004 |
| GB | 2414654 | A | 12/2005 |
| JP | 39-6833 | | 3/1939 |
| JP | 60-63175 | | 5/1985 |
| JP | 04250130 | A | 9/1992 |
| JP | 04288113 | A | 10/1992 |
| JP | 04312430 | A | 11/1992 |
| JP | 05025763 | | 2/1993 |
| JP | 05056902 | A | 3/1993 |
| JP | 05115403 | A | 5/1993 |
| JP | 05192285 | A | 8/1993 |
| JP | 05245090 | A | 9/1993 |
| JP | 05285435 | A | 11/1993 |
| JP | 06014858 | A | 1/1994 |
| JP | 06014859 | A | 1/1994 |
| JP | 06017356 | | 1/1994 |
| JP | 06162712 | A | 6/1994 |
| JP | 06182310 | A | 7/1994 |
| JP | 07011269 | A | 1/1995 |
| JP | 07169098 | A | 7/1995 |
| JP | 07184815 | A | 7/1995 |
| JP | 07254169 | A | 10/1995 |
| JP | 08043272 | A | 2/1996 |
| JP | 08092530 | A | 4/1996 |
| JP | 08133290 | A | 5/1996 |
| JP | 08187210 | A | 7/1996 |
| JP | 08243065 | A | 9/1996 |
| JP | 08291456 | A | 11/1996 |
| JP | 08293180 | A | 11/1996 |
| JP | 08302314 | A | 11/1996 |
| JP | 08302550 | A | 11/1996 |
| JP | 082979949 | A | 11/1996 |
| JP | 09038009 | A | 2/1997 |
| JP | 09055055 | A | 2/1997 |
| JP | 09055056 | A | 2/1997 |
| JP | 09098920 | | 4/1997 |
| JP | 09131288 | | 5/1997 |
| JP | 09135798 | | 5/1997 |
| JP | 09140650 | A | 6/1997 |
| JP | 09154519 | A | 6/1997 |
| JP | 09154791 | A | 6/1997 |
| JP | 09188950 | A | 7/1997 |
| JP | 09224895 | | 9/1997 |
| JP | 09253017 | | 9/1997 |
| JP | 09255679 | | 9/1997 |
| JP | 09273061 | A | 10/1997 |
| JP | 09276193 | | 10/1997 |
| JP | 09319305 | A | 12/1997 |
| JP | 09322876 | A | 12/1997 |
| JP | 09322877 | A | 12/1997 |
| JP | 09324354 | | 12/1997 |
| JP | 10005159 | A | 1/1998 |
| JP | 10005164 | A | 1/1998 |
| JP | 10033170 | A | 2/1998 |

(56) References Cited

FOREIGN PATENT DOCUMENTS

| | | | |
|---|---|---|---|
| JP | 10033343 | A | 2/1998 |
| JP | 10033443 | A | 2/1998 |
| JP | 10043115 | A | 2/1998 |
| JP | 10099246 | A | 4/1998 |
| JP | 10127547 | A | 5/1998 |
| JP | 10137168 | | 5/1998 |
| JP | 10146306 | A | 6/1998 |
| JP | 10203542 | A | 8/1998 |
| JP | 10216060 | | 8/1998 |
| JP | 10-235574 | A | 9/1998 |
| JP | 10237235 | A | 9/1998 |
| JP | 10245756 | | 9/1998 |
| JP | 1026288 | A | 10/1998 |
| JP | 10276953 | | 10/1998 |
| JP | 10286206 | | 10/1998 |
| JP | 10286209 | | 10/1998 |
| JP | 10328107 | | 12/1998 |
| JP | 11000295 | A | 1/1999 |
| JP | 11019015 | | 1/1999 |
| JP | 11089776 | A | 4/1999 |
| JP | 11156979 | | 6/1999 |
| JP | 11156980 | | 6/1999 |
| JP | 11156981 | | 6/1999 |
| JP | 11241099 | A | 9/1999 |
| JP | 1126750 | | 10/1999 |
| JP | 11276401 | | 10/1999 |
| JP | 11276402 | | 10/1999 |
| JP | 11302688 | A | 11/1999 |
| JP | 11318789 | A | 11/1999 |
| JP | 11332777 | A | 12/1999 |
| JP | 11332778 | A | 12/1999 |
| JP | 2000034663 | A | 2/2000 |
| JP | 2000083883 | | 3/2000 |
| JP | 2000166841 | | 6/2000 |
| JP | 2000210238 | A | 8/2000 |
| JP | 20000212879 | | 8/2000 |
| JP | 2000254088 | A | 9/2000 |
| JP | 2000254089 | A | 9/2000 |
| JP | 20000245670 | | 9/2000 |
| JP | 2000296084 | | 10/2000 |
| JP | 2001003094 | A | 1/2001 |
| JP | 2001059098 | A | 3/2001 |
| JP | 2001190487 | A | 7/2001 |
| JP | 2001198065 | A | 7/2001 |
| JP | 2001198066 | A | 7/2001 |
| JP | 2001269300 | A | 10/2001 |
| JP | 2001288659 | A | 10/2001 |
| JP | 2001299658 | A | 10/2001 |
| JP | 20011275875 | A | 10/2001 |
| JP | 20011310168 | A | 11/2001 |
| JP | 2001354238 | A | 12/2001 |
| JP | 2002000645 | A | 1/2002 |
| JP | 2002119451 | A | 4/2002 |
| JP | 2002119929 | A | 4/2002 |
| JP | 2002145367 | A | 5/2002 |
| JP | 2002165742 | | 6/2002 |
| JP | 2002191536 | A | 7/2002 |
| JP | 2002233486 | A | 8/2002 |
| JP | 2002240179 | A | 8/2002 |
| JP | 20002253459 | A | 9/2002 |
| JP | 2002306389 | A | 10/2002 |
| JP | 2002315704 | A | 10/2002 |
| JP | 2002363509 | A | 12/2002 |
| JP | 2002369783 | A | 12/2002 |
| JP | 2003000234 | A | 1/2003 |
| JP | 2003024254 | A | 1/2003 |
| JP | 2003111701 | A | 4/2003 |
| JP | 2003111703 | A | 4/2003 |
| JP | 2003111704 | A | 4/2003 |
| JP | 2003164402 | A | 6/2003 |
| JP | 2003164407 | A | 6/2003 |
| JP | 2003164408 | A | 6/2003 |
| JP | 2003190074 | A | 7/2003 |
| JP | 2003199698 | A | 7/2003 |
| JP | 2003204911 | A | 7/2003 |
| JP | 2003238394 | A | 8/2003 |
| JP | 2003261899 | A | 9/2003 |
| JP | 2003265387 | A | 9/2003 |
| JP | 2003265391 | A | 9/2003 |
| JP | 2003284660 | A | 10/2003 |
| JP | 2003319898 | A | 11/2003 |
| JP | 2004033237 | A | 2/2004 |
| JP | 2004033238 | A | 2/2004 |
| JP | 2004049605 | A | 2/2004 |
| JP | 2004057242 | A | 2/2004 |
| JP | 2004057244 | A | 2/2004 |
| JP | 2004065387 | A | 3/2004 |
| JP | 2004089288 | A | 3/2004 |
| JP | 2004141369 | A | 5/2004 |
| JP | 2004167274 | A | 6/2004 |
| JP | 2004208917 | A | 7/2004 |
| JP | 2004208939 | A | 7/2004 |
| JP | 2004208941 | A | 7/2004 |
| JP | 2004223022 | A | 8/2004 |
| JP | 2004223692 | A | 8/2004 |
| JP | 2004237023 | A | 8/2004 |
| JP | 2004275605 | A | 10/2004 |
| JP | 2004298650 | A | 10/2004 |
| JP | 2004351070 | A | 12/2004 |
| JP | 2005006778 | A | 1/2005 |
| JP | 2005007094 | A | 1/2005 |
| JP | 2005021709 | A | 1/2005 |
| JP | 2005040641 | A1 | 2/2005 |
| JP | 2005046645 | A | 2/2005 |
| JP | 2005087506 | A | 4/2005 |
| JP | 2005095643 | A | 4/2005 |
| JP | 2005095665 | A | 4/2005 |
| JP | 2005111284 | A | 4/2005 |
| JP | 2005118392 | A | 5/2005 |
| JP | 2005124857 | A | 5/2005 |
| JP | 2005131422 | A | 5/2005 |
| JP | 2005137603 | A | 6/2005 |
| JP | 2005137929 | A | 6/2005 |
| JP | 2005137930 | A | 6/2005 |
| JP | 2005137931 | A | 6/2005 |
| JP | 2005143523 | A | 6/2005 |
| JP | 2005144111 | A | 6/2005 |
| JP | 2005144198 | A | 6/2005 |
| JP | 2005144199 | A | 6/2005 |
| JP | 2005160721 | A | 6/2005 |
| JP | 2005168711 | A | 6/2005 |
| JP | 2005169096 | A | 6/2005 |
| JP | 2005169148 | A | 6/2005 |
| JP | 2005199077 | A | 7/2005 |
| JP | 200615164 | A | 1/2006 |
| WO | 97/79326 | | 12/1997 |
| WO | 98/52458 | | 11/1998 |
| WO | 99/07272 | | 2/1999 |
| WO | 99/07273 | | 2/1999 |
| WO | 99/23291 | | 5/1999 |
| WO | 99/37842 | | 7/1999 |
| WO | 00/08998 | | 2/2000 |
| WO | 00/53407 | | 9/2000 |
| WO | 01/22861 | A2 | 4/2001 |
| WO | 01/40558 | A2 | 6/2001 |
| WO | 01/41622 | A2 | 6/2001 |
| WO | 01/45616 | A1 | 6/2001 |
| WO | 01/52713 | A2 | 7/2001 |
| WO | 01/80705 | A2 | 11/2001 |
| WO | 01/85452 | A1 | 11/2001 |
| WO | 01/92622 | A1 | 12/2001 |
| WO | 02/00819 | A1 | 1/2002 |
| WO | 02/03847 | A2 | 1/2002 |
| WO | 02/30827 | A2 | 5/2002 |
| WO | 02/34101 | A1 | 5/2002 |
| WO | 02/38846 | A2 | 5/2002 |
| WO | 02/41745 | A1 | 5/2002 |
| WO | 02/43536 | A2 | 6/2002 |
| WO | 02/45564 | A2 | 6/2002 |
| WO | 02/49496 | A1 | 6/2002 |
| WO | 02/053694 | A1 | 7/2002 |
| WO | 02/065887 | A1 | 8/2002 |
| WO | 02/091900 | A1 | 11/2002 |
| WO | 02/002221 | A1 | 12/2002 |

(56) References Cited

FOREIGN PATENT DOCUMENTS

| | | | |
|---|---|---|---|
| WO | 03/000165 | A1 | 1/2003 |
| WO | 03/001962 | A1 | 1/2003 |
| WO | 03/004748 | A1 | 1/2003 |
| WO | 03/039321 | A1 | 5/2003 |
| WO | 03/059139 | A1 | 7/2003 |
| WO | 03/070080 | A1 | 8/2003 |
| WO | 03/093557 | A1 | 11/2003 |
| WO | 03/099517 | A1 | 12/2003 |
| WO | 2004/008931 | A | 1/2004 |
| WO | 2004/020725 | A1 | 3/2004 |
| WO | 2004/022832 | A1 | 3/2004 |
| WO | 2004/044298 | A1 | 5/2004 |
| WO | 2004/048047 | A1 | 6/2004 |
| WO | 2004/060130 | A1 | 7/2004 |
| WO | 2004/061185 | A1 | 7/2004 |
| WO | 2004/061187 | A1 | 7/2004 |
| WO | 2004/062821 | A | 7/2004 |
| WO | 2004/064590 | A2 | 8/2004 |
| WO | 2004/073479 | A2 | 9/2004 |
| WO | 2005/002842 | A1 | 1/2005 |
| WO | 2005/065517 | A2 | 7/2005 |
| WO | 2005/084515 | A | 9/2005 |
| WO | 2005/099552 | A2 | 10/2005 |
| WO | 2005/100520 | A1 | 10/2005 |
| WO | 2005/100521 | A1 | 10/2005 |
| WO | 2005/100523 | A1 | 10/2005 |
| WO | 2005/100526 | A1 | 10/2005 |
| WO | 2005/100527 | A1 | 10/2005 |
| WO | 2005/103217 | A1 | 11/2005 |
| WO | 2005/103218 | A1 | 11/2005 |
| WO | 2005/103244 | A1 | 11/2005 |
| WO | 2005/103354 | A1 | 11/2005 |
| WO | 2005/103355 | A1 | 11/2005 |
| WO | 2005/103357 | A1 | 11/2005 |

* cited by examiner

CLEANING KIT INCLUDING DUSTER AND SPRAY

CROSS-REFERENCE TO RELATED APPLICATIONS

This application is a divisional application of U.S. patent application Ser. No. 11/450,839 filed on Jun. 9, 2006, which is a continuation-in-part of U.S. patent application Ser. Nos. 11/045,204 and 11/351,756, filed on Jan. 28, 2005 and Feb. 10, 2006, respectively, the entireties of which are incorporated by reference herein.

BACKGROUND OF THE INVENTION

1. Field of the Invention

The present invention relates to the field of cleaning devices such as hand held dusters and dust mops. More particularly, the present invention relates to a cleaning kit having preferably a cleaning pad, a handle, a pad support connected to the handle, a fluid for cleaning associated therewith, and instructions for using the same.

2. Discussion of the Related Art

For decades, hand held feather dusters, dust rags and other cleaning implements have been used as cleaning tools for the removal of dust adhering to furniture such as dressers and coffee tables, electrical appliances such as computers, lights, interior walls, lintels and the like. Thus, it is generally well known to remove dust or dirt from floors, furniture, and other household surfaces by rubbing a dust rag, cloth or other cleaning implement against the surface such that the dust or dirt adheres to the cleaning implement.

Throughout the last half-century, new cleaning implements have been developed to assist the individual in dusting and similar cleaning chores. While hand held dusters and other cleaning implements are generally well known in the art, numerous drawbacks exist with the current commercially available designs. For example, US Application Pub. No. US 2004/0034956 A1, U.S. Pat. Nos. 6,813,801, 5,953,784, 6,550,092, and 6,777,064 disclose variations of cleaning devices incorporating a disposable cleaning pad. These devices, while somewhat suitable for the desired application, have limitations.

Therefore, there is a need in the art to increase the dust adhesion of traditional cleaning pads and have a kit for doing the same.

SUMMARY AND OBJECTS OF THE INVENTION

An inventive kit includes a cleaning pad, an associated spray bottle, and preferably an attached handle with a support. A method of increasing dust adhesion with the kit for dusting is also disclosed in suitable detail to enable one of ordinary skill in the art to make and use the invention.

In one preferred embodiment, the article of manufacture comprises: a) a cleaning implement; b) a disposable cleaning substrate; c) an attachable reservoir containing a cleaning composition; and d) a set of instructions comprising the steps of: i) applying the cleaning composition to the pad, ii) wiping a surface with the disposable cleaning substrate, and iii) cleaning the surface.

In another preferred embodiment, the invention is an article of manufacture comprising a cleaning pad, cloth or sheet with free hanging fibers and an additive applied thereto to provide improved adhesion of soil to said sheet, said sheets being in a package in association with instructions, and a cleaning fluid for use with the sheets.

In another preferred embodiment, the invention is a wet duster system comprising a handle, instructions for the handle, a container having liquid, and a cleaning pad for use with the liquid.

In yet another preferred embodiment, the invention is a cleaning kit comprising: a handle, a movable support for pivoting the handle from a cleaning position to a storage position, a cleaning pad in communication with the support and having a combination of fibers and at least one nonwoven sheet without any fringes, strips, or cuts. Preferably, the kit contains instructions on use of a fluid reservoir for use with the cleaning pad and a description of the benefits in controlling allergens.

These, and other, aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
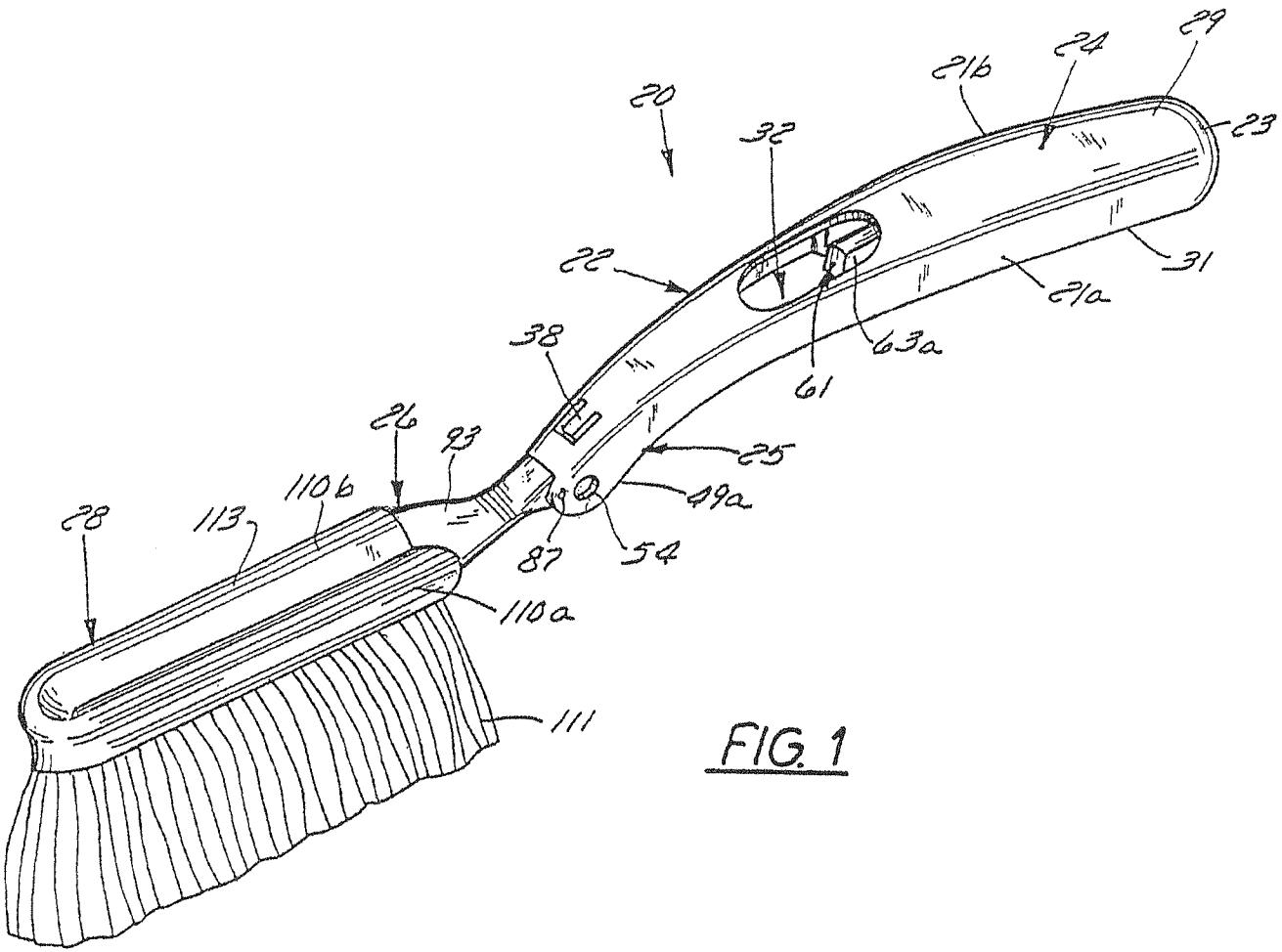
FIG. 1 is a perspective view of a first embodiment of an assembled cleaning kit capable of wet or dry cleaning, the cleaning system shown in a first cleaning position or 9 o'clock position.

In describing the preferred embodiment of the invention, which is illustrated in the drawings, specific terminology will be resorted to for the sake of clarity. However, it is not intended that the invention be limited to the specific terms so selected and it is to be understood that each specific term includes all technical equivalents, which operate in a similar manner to accomplish a similar purpose. For example, the word "connected" or "attached" or terms similar thereto are often used. They are not limited to direct connection and attachment but include connection and attachment through other elements where such connection and attachment is recognized as being equivalent by those skilled in the art.

DESCRIPTION OF PREFERRED EMBODIMENTS

The present invention and the various features and advantageous details thereof are explained more fully with reference to the non-limiting embodiments described in detail in the following description.

1. System Overview

In a basic form, the invention is kit with a cleaning pad that exhibits improved dust retention on a surface to be cleaned through preferably the application of a liquid or other additive to the cleaning pad. The pad generally includes a combination of fibers and at least one nonwoven sheet. Alternatively, a component of additive may be applied to the pad during manufacture. The kit preferably includes a handle and an instruction set.

2. Detailed Description of Preferred Embodiments

Specific embodiments of the present invention will now be further described by the following, non-limiting examples which will serve to illustrate various features of significance. The examples are intended merely to facilitate an understanding of ways in which the present invention may be practiced and to further enable those of skill in the art to practice the present invention. Accordingly, the below examples should not be construed as limiting the scope of the present invention.

Figure 2:
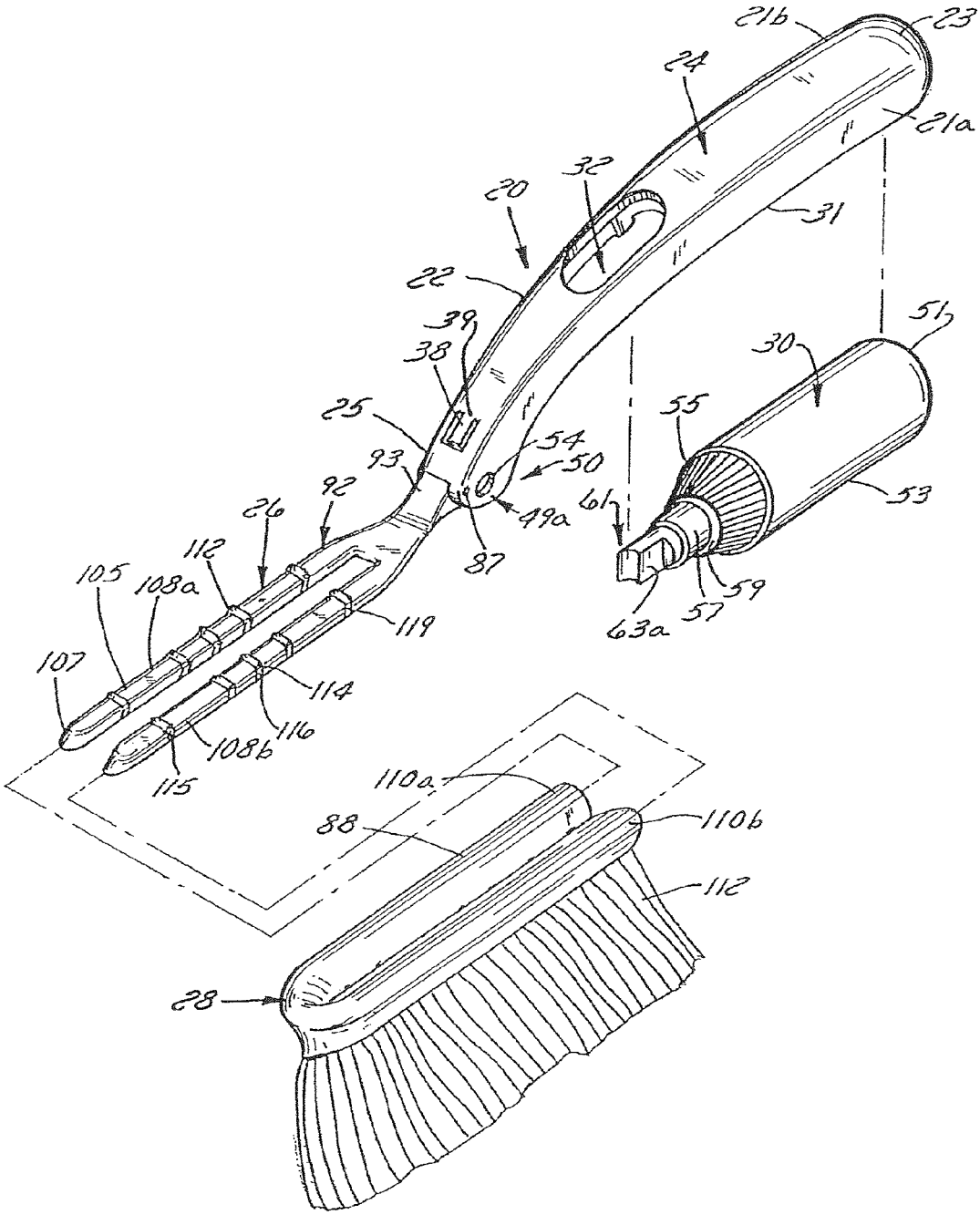
FIG. 2 is an exploded perspective view of the component parts of the kit illustrated in FIG. 1.

The inventive article of manufacture includes a cleaning kit or system 20 that is illustrated according to one preferred embodiment of the present invention in FIGS. 1 and 2. Cleaning kit or system 20 is preferably comprised of a cleaning tool or implement 22, including a) a grip handle portion or handle 24, b) a pivotally attached cleaning pad support member, cleaning implement support member or cleaning media support 26, c) a liquid delivery system, cleaning fluid dispenser, or reservoir 30, and d) a cleaning sheet, substrate, cloth, pad, or cleaning media 28 attached to the cleaning tool 22 via the cleaning pad support member 26.

Handle portion 24 is preferably a curved ergonomically designed member configured to comfortably fit within the palm of a hand of a user. Handle portion 24 includes an integral top 29, first sidewall 21*a*, second sidewall 21*b*, forward end 25, rear wall 23, and bottom 31. Handle portion 24 may be constructed from a variety of synthetic resins, plastics or other suitable materials. In the preferred embodiment, handle portion 24 is constructed from polypropylene. Although the handle portion 24 may be constructed in a wide variety of sizes depending on the intended use, in one preferred embodiment, handle portion 24 is approximately 8.5 inches long, 1.3 inches wide and 1.7 inches high. These dimensions allow for ease of use, manipulation, packaging, shipping and storage of the cleaning kit or system 20 as well as increasing its overall ergonomics. Handle portion 24 may be constructed in a variety of colors for increased aesthetic appeal. It may additionally be constructed from a translucent material.

Figure 6:
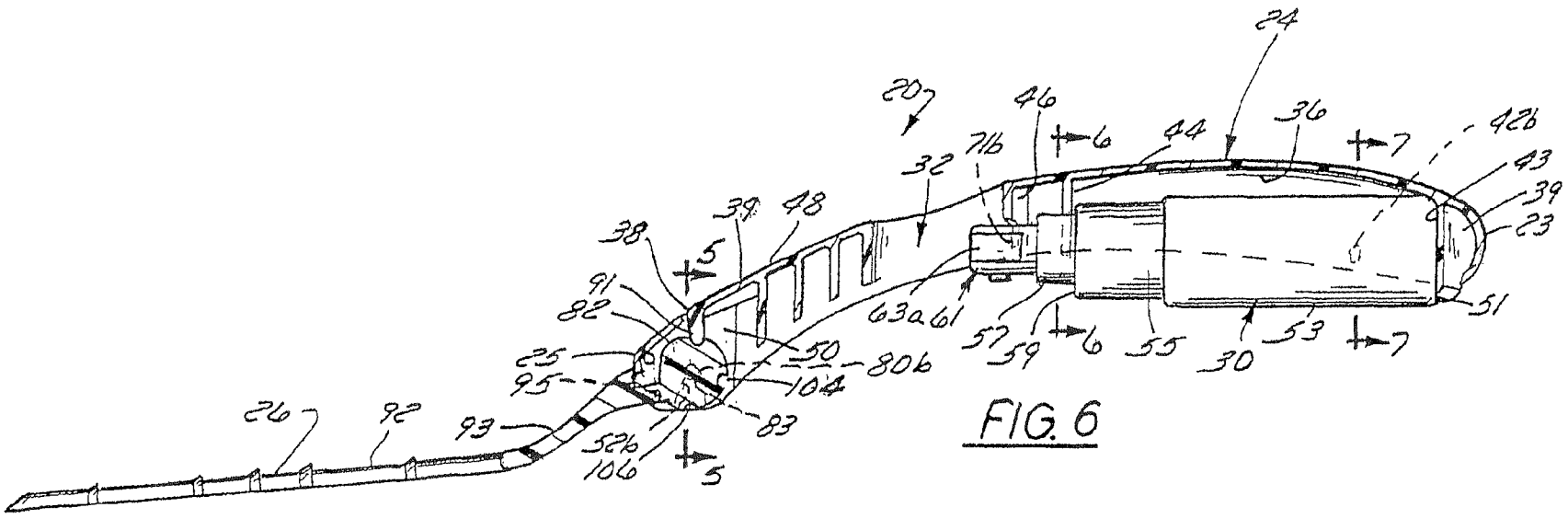
FIG. 6 is a vertical cross-sectional view of the components of the cleaning kit taken along the longitudinal axis of the device illustrated in FIGS. 1-4.
Figure 9:
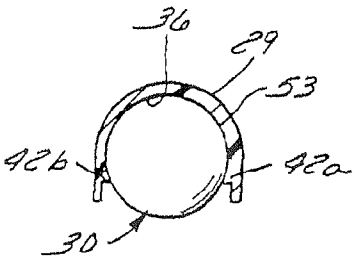
FIG. 9 is a sectional view taken along line 7-7 of FIG. 6.

As will be described in greater detail below, handle portion 24 preferably also defines a recess. The recess is preferably a liquid reservoir receiving cradle, recess, or fluid bay 36 (FIG. 6). In the preferred embodiment, the insertion of the fluid dispenser, container, or reservoir 30 into the cradle 36 finishes the ergonomic design or form of the handle portion 24. Thus, the palm of a user's hand extends over the top 29 handle portion 24 and the user's fingers extend at least partially around the fluid reservoir 30. Additionally, the preferred curved ergonomic design of the of the handle portion 24 is constructed in a manner such that the pivot point defined by the pivot member receiving cavity 50 is located below the horizontal plane defined by the fluid reservoir 30 within the cradle 36. Such an orientation is advantageous in maximizing fluid application as discussed in greater detail below.

Near the center of the handle portion 24 is an opening. Preferably, the opening is a hole 32 extending through handle portion 24 into the bottom 31 of the handle portion 24. In the illustrated embodiment, preferably hole 32 is approximately 2.5 inches from a pivot member-receiving cavity 50 located at the forward end 25 of the handle portion 24. As illustrated in FIG. 6, opening 32 provides a user single-handed access into fluid bay 36 defined in the bottom 31 of the handle portion 24. Near the forward end 25 of the handle portion 24, above the pivot member-receiving cavity 50 is a cantilevered pivot engagement tab 38, extending downwardly into the pivot member receiving cavity 50 described in greater detail below.

FIG. 2 illustrates one preferred embodiment of a fluid reservoir 30 of the cleaning kit or system 20. In the illustrated embodiment, fluid reservoir 30 is in the form of a fluid dispenser or a pump-activated spray bottle configured to contain or retain water or a specialized fluid. The fluid may be comprised of a variety of known products. Preferably the fluid is a liquid selected from the commercially available Febreze®, Pledge® Multi-Surface Cleaner, Pledge® Wood and Glass Cleaner, Endust®, Fantastic® all purpose cleaner, Windex® glass cleaner, antibacterials such as Oust® or Lysol®, fragrances such as Glade®, leather or vinyl treatment such as Armor All®, fabric protectors such as Scotchgard®, or fabric fresheners such as those manufactured by S.C. Johnson & Son, Inc. of Racine, Wis. The fluid may alternatively generally comprise, without limitation: any all-purpose cleaner, oil or water based dust inhibitor, a cleaning foam, anti-static, anti-microbial, antibacterial, sanitizing and de-odorizing agent, dusting agent, glass cleaner, furniture polish, leather or vinyl treatment, other cleaning agent, wax, polish or shining agent, softening agent, friction-enhancing compound, perfumes, dish cleaner, soap, insect repellent or insect barrier, exfoliator or other personal care product, paint for sponge painting or other application, water out emulsions, oil out emulsions, dust mite killer or repellant, abrasive cleaner, shoe polish, pet sanitation products, etc.

As described in greater detail below, the fluid reservoir 30 may also include an additive that delivers amphiphilic (exhibiting both hydrophilic and hydrophobic properties) properties to the cleaning pad 28. The additive may be an anionic surfactant, a cationic surfactant, a zwitterionic surfactant, an amphoteric surfactant, a solvent with hydrogen bonding character, or an organic molecule with an ionizable polar head group. The additive may include an alcohol, a surfactant, a functionalized silicone, a non-functionalized silicone, a carboxylic acid, monoethanol amine or an amine. In an alternative embodiment, the additive may also include a mineral oil or wax. For example, the additive may be disodium cocoamphodiacetate marketed as Mackam™ 2CSF manufactured by, for example, McIntyre Group, Ltd. or disodiumdecyl (sulphonatophenoxy) benzenesulfonate.

These amphiphilic additives may include a solvent, like isopropylalcohol (IPA) or other alcohols including polyalcohols and glycol-ether solvents (for example; propylene glycol and ethylene glycol N Hexyl ether), functionalized or non-functionalized silicones, carboxylic acids which can act as surfactants, and monoethanol amine (pH control and basic solvent). Aldehydes (for example formaldehyde as a preservative, or acetaldehyde) may be included but are not necessarily preferred.

As illustrated in FIG. 2, the preferred container 30 is a generally cylindrical bottle having an integral bottom 51, sidewall 53, second 55 and third 57 sections. A spray cap or nozzle 61 is preferably screwed or press fitted onto the top of the spray bottle. The spray cap 61 includes a pair of opposed flats 63*a*, 63*b* configured to selectively engage flanges 71*a*, 71*b* of the fluid cradle 36. Alternatively, a system of tabs and grooves could be used to form a similar key and lock mechanism. The spray cap 61 could alternatively include a one sided flat button or a tapered button. In addition to the illustrated spray bottle, the fluid reservoir 30 could take a variety of forms, including an aerosol package, a deformable handle or reservoir that dispenses fluid by squeezing, a squirt gun with trigger, or a flexible pouch with spray nozzle. While the fluid reservoir 30 is illustrated as fitting within the cradle 36 of the handle portion 24, the fluid reservoir may alternatively completely form the handle of the system, having only the upper portion of the cleaning system attached (i.e. the pivot member and the attachment members).

It should be recognized that opposed flats 63*a*, 63*b* of the spray cap 61 provide for a tight fit within the handle portion 24, and further serve to properly orientate the fluid reservoir 30 within the cleaning system 20. Alternatively, it is understood that the fluid reservoir 30 could include other uniquely designed contours that allow for a mating tight fit within the fluid reservoir-receiving cradle 36. A more detailed description of the components of the underside of the handle is contained in U.S. application Ser. No. 11/124,527, which is incorporated herein by reference. Further, key and lock configurations are contemplated to ensure only high quality spray products are used with the tool.

Figure 5:
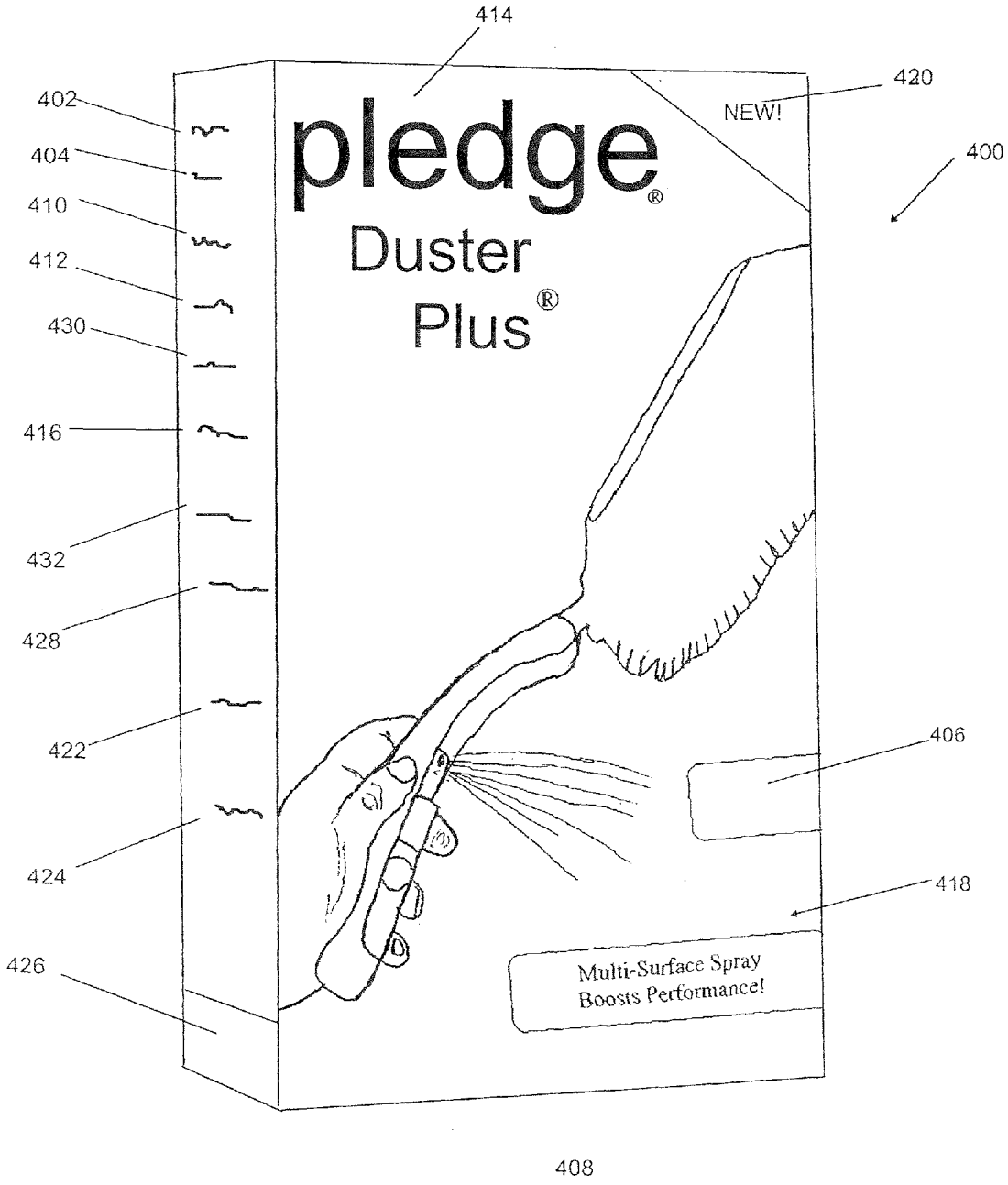
FIG. 5 is a perspective view of an embodiment including a package for the cleaning kit.

FIG. 5 shows a possible configuration for a package for the cleaning kit described above. The package is further described below.

Figure 8:
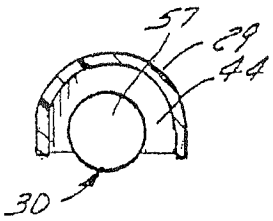
FIG. 8 is a sectional view taken along line 6-6 of FIG. 6.
Figure 7:
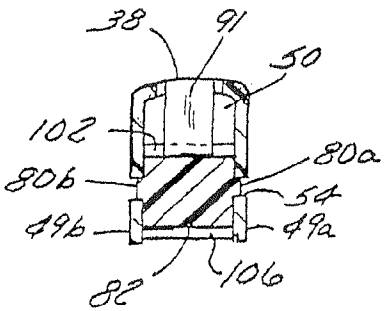
FIG. 7 is a sectional view taken along line 5-5 of FIG. 6.

As illustrated in FIGS. 6 and 8, first bottleneck receiving support 44 is configured to press fit around the fluid reservoir 30 near the junction 59 of the second 55 and third 57 sections of the reservoir 30.

Slightly forward of the first bottleneck receiving support 44 is a second U-shaped spray cap receiving support 46. Spray cap receiving support 46 is configured to preferably press fit around, retain and orientate the spray cap 61 of the fluid reservoir 30. As best illustrated in FIG. 6, spray cap receiving support 46 is defined by a pair of flanges 71*a*, 71*b* extending from the inner side of opposed sidewalls 21*a*, 21*b*. Flanges 71*a*, 71*b* are configured to press fit around flats 63*a*, 63*b* of fluid reservoir spray cap 61 when the reservoir is placed within the cradle 36. The tight fit defined by flanges 71*a*, 71*b* and flats 63*a*, 63*b* serves to properly orientate spray cap 61 within the fluid reservoir-receiving cradle 36 such that spray cap 61 faces in a direction away from the cradle 36. Forward of the opening 32, are a plurality of structural support ribs 48 extending forwardly towards the pivot member-receiving cavity 50.

Figure 11:
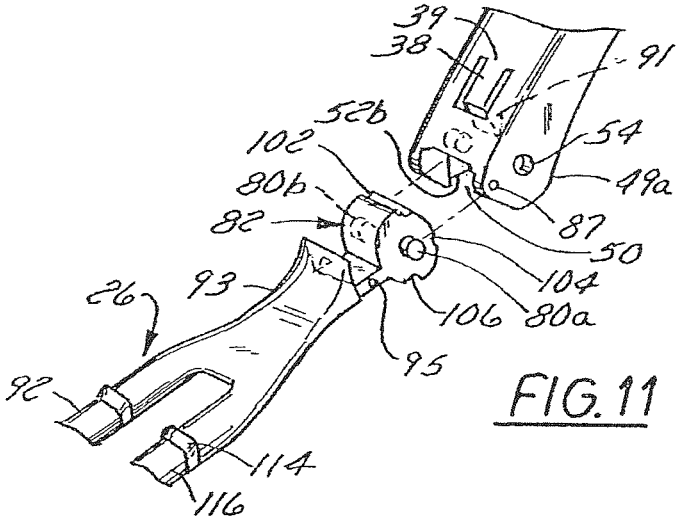
FIG. 11 is an exploded partial perspective view of the pivot assembly of the inventive cleaning kit illustrated in FIGS. 1-4.

Turning now to FIGS. 6 and 11, at the forward end 25 of the bottom 31 of the handle portion 24 is a pivot member receiving cavity 50. Pivot member receiving cavity 50 is defined between integral opposed ears 49*a*, 49*b* located at the forward end 25 of the handle portion 24. Ears 49*a*, 49*b* include opposed grooves 52*a*, 52*b* on their inner cavity surface configured to slidably engage the axles 80*a*, 80*b* of a circular pivot member 82 during assembly. Grooves 52*a*, 52*b* have a width that is equal to or slightly wider than the diameter of the axles 80*a*, 80*b* of the circular pivot member 82. It is understood that grooves 52*a*, 52*b* and the pivot member receiving cavity 50 are configured to accommodate a variety of alternative cleaning pad support members 26 or other cleaning implements having pivot members 82 attached at their proximal ends.

At the terminal end of the grooves 52*a*, 52*b*, are pivot holes 54 configured to receive the axles 80*a*, 80*b* of the circular pivot member 82 and allow pivotable motion therein. A curved slot 83 extends laterally from grooves 52*a*, 52*b* and defines a passage configured to allow the movement of circular pivot retention tabs 95 extending from the pivot member 82. On opposed sides of the forward end of the pivot member receiving cavity 50 are circular pivot retention tab holes 87 configured to engage and receive the circular pivot retention tabs 95 located on the pivot member 82.

Projecting downwardly from the top 29 of the handle portion 24 into the pivot member receiving cavity 50 is a resiliently biased semi-flexible pivot engagement tab 38. Engagement tab 38 is comprised of a first end 39 attached to the handle portion 24 and a second free end 91 configured to engage notches 102, 104, 106 on the outer surface of the pivot member 82 as will be described in greater detail below.

Attached within the pivot member-receiving cavity 50 of the handle portion 24 is the cleaning pad support member 26. Cleaning pad support member 26 is preferably comprised of an integral circular pivot member 82, linking section 93 and support head generally designated 92. Circular pivot member 82 includes integral axles 80*a*, 80*b* on its opposed lateral sides. As best shown in FIG. 11, axles 80*a*, 80*b* are configured to fit within pivot holes 54 and rotatably pivot therein. Pivot member 82 also includes a circular pivot retention tab 95. Circular retention tabs 95 are configured to fit within retention tab holes 87 and support the system in the cleaning position. Pivot member 82 defines three notches or indentations 102, 104, 106 corresponding to alternative positions of the cleaning pad support member 26. A cleaning position notch 102, liquid application notch 104 and storage position notch 106 are defined on the external surface of the pivot member 82. In general, the preferred pivot assembly requires about between 2-3 lbs of pivot force in order to rotate it.

Integral with and extending from the pivot member 82 is the linking section 93 and support head 92. In the preferred embodiment, support head 92 of cleaning pad support member 26 includes a pair of parallel attachment members or attachment prongs 108*a*, 108*b* configured to engage the pockets or sleeves 110*a*, 110*b* of a cleaning pad 28 as is generally known in the art. Attachment members 108*a*, 108*b* may be spaced apart in a variety of configurations, however, in the preferred embodiment, attachment members 108*a*, 108*b* have a total width of about 1.25 inches from opposed outside lateral edges. The preferred attachment members 108*a*, 108*b* are about 6.75 inches long, about 0.75 inches thick, and about 0.80 inches wide. Attachment members 108*a*, 108*b* preferably define a rounded leading edge 107 configured for ease of insertion into the sleeves 110*a*, 110*b* of cleaning pad 28. It is recognized that although the preferred embodiment illustrates a pair of attachment members 108*a*, 108*b* multiple configurations may be utilized. For example, a single, wider attachment member could be utilized. Alternatively, three or more attachment members could be utilized. Triangular or other shaped configurations for the support are also possible.

Attachment members 108*a*, 108*b* include a plurality of spaced cleaning pad retaining tabs, barbs or projections 112 projecting from their upper surface 105. In the illustrated embodiment, retaining tabs 112 are triangular-shaped tabs that have a first wall 114 extending in a generally vertical direction from the upper surface of the attachment members 108*a*, 108*b* and a second angled wall 116 sloping from the upper edge of the first wall 114 towards the distal end of the attachment members 108*a* 108*b*. Tabs 112 are preferably raised about 0.050 inches from the attachment members 108*a*, 108*b*. The unique triangular configuration of the retaining tabs 112 serves a dual function. The angled wall 116 allows for ease of placement of the cleaning pad 28 on the attachment members 108*a*, 108*b* during assembly, while the vertical first wall 114 retains the cleaning pad 28 on the attachment members 108*a*, 108*b* during the cleaning motion.

In addition to the unique configuration of the retaining tabs 112, their orientation on the attachment members 108*a*, 108*b* also serves to maintain the cleaning pad 28 on the attachment members 108*a*, 108*b*. In the illustrated embodiment, the retaining tabs 112 are staggered and include a leading tab 115, three intermediary tabs 117 and a trailing tab 119. In the illustrated embodiment, each attachment member 108*a*, 108*b* includes five retaining tabs 112. Testing has illustrated that when the retaining tabs 112 are spaced an equal distance from one another, their retention function is not as great as when the tabs are placed in an staggered configuration as illustrated in the preferred embodiment. In the preferred embodiment, the first tab is spaced 1.0 inch, the second is spaced 2.0 inches, the third 2.5 inches, the fourth 3.0 inches and the fifth 4.0 inches from the rounded leading edge 107.

In one embodiment, the attachment members 108*a*, 108*b* may be expandable, inflatable, partially inflatable, or include an inflatable portion. The inflatability provides for an improved fit of the cleaning pad 28 on the attachment members 108*a*, 108*b* as well as facilitating hands free removal of the cleaning pad 28 from the attachment members 108*a*, 108*b*.

Cleaning pad 28 is generally known in the art and comprised of a combination of fibers defining a cleaning surface 111 and attachment portion 113. The cleaning pad 28 may, for example, include a plurality of fluffed nonwoven fabrics made of synthetic resins, which may be welded to one another. The pad may include fibers constructed from PP, PE, PET fibers in a variety of alternative percentages by weight. In the illustrated embodiment, attachment portion 113 defines a pair of pockets or sleeves 110*a*, 110*b* configured to receive the attachment members 108*a*, 108*b* of the cleaning pad support member 26. Cleaning pad 28 is preferably, a 20 g/sqm spun lace cloth with between 1-4% mineral oil manufactured by Haso Corporation of Japan. Such cleaning or dusting pads are described in PCT/JP2004/10507 the entirety of which is expressly incorporated by reference.

When the cleaning kit or system 20 is used, the sleeve-like cleaning pad 28 is mounted over the attachment members 108*a*, 108*b* so that all of the retaining tabs 112 are within the sleeves 110*a*, 110*b*. The retaining tabs 112 are, in this configuration, thus capable of being fully enclosed by the cleaning pad 28, avoiding the possibility of the attachment members 108*a*, 108*b* scratching delicate furniture or other items being contacted.

The cleaning surface 111 of cleaning pad 28 may be comprised of a polymer that allows for the spontaneous transport of aqueous fluids. Such polymers are described in, for example, U.S. Pat. Nos. 5,723,159, 5,972,505 and 5,200,248 the disclosures of which are expressly incorporated by reference.

It should be recognized that the polymer fibers of the cleaning pad can take a variety of forms to increase various performance characteristics of the cleaning system 20. Standard circular fibers may be used, as is generally known in the art. Alternatively, the individual fibers on the cleaning pad may be lobed in the form of loose "tow" fibers. The lobed configuration creates channels within the individual fibers enabling improved capillary action on each individual fiber and increasing the overall cleaning or dusting surface area thereby increasing the overall efficiency of both wet and dry dusting. The higher surface area results in an increase in the proportion of particles adhering in the grooves or channels and results in dust particles being "trapped" within the grooves of the lobed fiber. The lobed fibers generally exhibit improved dust retention, more efficient wet wiping and longer life than standard circular fibers. Furthermore, the lobed fibers can be made stiffer thereby generating a higher wiping pressure in a smaller contact area. It is understood that the inventive lobed fibers could be comprised of a multitude of polymers with PP, PE or PET being recognized as the most cost effective alternatives. Alternatively, acrylic or biodegradable polymers could be utilized.

In another alternative embodiment, the cleaning pad 28 may include stiffer or strut fibers attached to mass of tow fibers. In this arrangement, the stiffer fibers (usually in the range of about 0.3 mm) carry the majority of the stress applied to the cleaning pad 28. The tow may be linked to the stronger fibers by entanglement at the outer ends of the fiber. The stiffer fibers result in a cleaning pad 28 that is springy resulting in a more desirable feel of applied force for users. The stiffer fibers can further be utilized to clean difficult areas such as crevices, blinds or screens. The stiffer fibers have the further advantage in that they keep the tow volume expanded, thereby increasing dust migration into the tow fibers.

In yet another alternative embodiment, the cleaning pad 28 could include absorbent materials in particulate form fixed onto the remaining fibers of the cleaning pad 28. The absorbent materials may take the form of known super absorbent polymers SAP. The SAPs may be, for example, acrylic based polymers applied as a coating or turned into fibers directly. Such commercially available SAPs generally include X-linked polyacrylic acids or X-linked starch-acrylic-acid-graft-polymers, the carboxyl groups of which are partially neutralized with sodium hydroxide or caustic potash. The SAPs may be made by such processes as a solvent or solution polymerization method or the inverse suspension or emulsion polymerization method. Such SAPs are disclosed in, for example, U.S. Pat. No. 6,124,391 the disclosure of which is hereby expressly incorporated by reference.

The absorbent materials increase the overall absorbency of the fibers, prevent the fibers from packing close together into a fiber mass, and enhance the friction of the fibers. The "string of pearls" arrangement also allows for strategically placed high absorbency regions on the cleaning pad. For example, if it is desirable to have the forward end of the cleaning pad 28 be more absorbent than the remainder of the cleaning pad 28, the forward end could include a higher percentage of the particulate absorbent materials.

The cleaning pad 28 could also include fibers that are formed into helices. Such fibers can be formed by drawing fiber bundles over a blade or heating coaxial bicomponent fibers. The resulting helical fibers exhibit a fluffier texture and more attractive appearance while at the same time increasing the volume (while using less fiber) and dust retention of the duster. The helical nature of the fibers is also advantageous in that they allow coarse fibers to feel softer due to the spring effect. Furthermore, the fibers gradual loss of the helical nature, can serve as an indication of the effective life of the cleaning pad.

It should be recognized that none of the aforementioned fiber materials or configurations are exclusive. The cleaning pad could include strategic combinations of the various fibers and other known fibers. In one example, the cleaning pad may be comprised of between 25-100% of the lobed fibers by weight.

Similarly, although the preferred embodiment discloses a single cleaning surface 111, the invention is in no way limited to such a single cleaning surface. To the contrary, numerous alternative configurations are within the scope of the present invention. For example, the inventive pad could include multiple cleaning surfaces, with alternate or similar fiber configurations to accommodate various cleaning functions. In one embodiment, a cleaning pad 28 could be two sided with one side for dusting and the alternate side of the cleaning pad 28 for cleaning. This could also be accomplished by turning the pad "inside out" to expose a new, clean surface. Alternatively, a triangular or other multi-sided cleaning pad 28 could be utilized. Circular, oval, rounded or other shaped cleaning pads are also envisioned and within the scope of the present invention. In general, a variety of cleaning pad 28 shapes or configuration could be utilized to maximize the various properties of the cleaning pad 28 and selected fibers.

As noted above, the orientation and type of fibers utilized on the cleaning pad 28 could include a wide variety of alternatives. For example and in no way limiting, the cleaning pad 28 could include a generally fluffy pad including a flat center strip around the area defined by the pockets or sleeves 110*a*, 110*b*. Such an orientation may increase the surface area and exhibit a better efficacy. Additionally, the center strip could include an absorbent pillow or tube extending down the center of the cleaning pad 28. Such an absorbent pillow could provide an area of high absorbency on the cleaning pad 28. Various alternative combinations are envisioned including, for example, cleaning pads consisting of alternating sections of sponges, feather-like structures, micro-fibers or cellulose foam. Wood pulp is preferred.

The cleaning pad 28 could also include a fluffy cloth with a hydrophilic additive to improve the absorbency of water. Such hydrophilic additives include but are not limited to glycerin and glycols. The cleaning pad 28 could also be comprised entirely of an absorbent material such as rayon. The cleaning pad 28 could also have a fragrance added to improve the smell of the cleaning pad 28.

The cleaning pad 28 or cleaning pad support member 26 could also include a piezoelectric crystal to impart an electrostatic charge on the cleaning pad during use to increase dust retention. Such crystals are generally known and typically generate a charge when subjected to mechanical stress. Examples of materials that can be used include but are not limited to quartz analogue crystals like berlinite ($AlPO_4$) and gallium orthophosphate ($GaPO_4$), ceramics with perovskite or tungsten-bronze structures ($BaTiO_3$, $KNbO_3$, $LiNbO_3$, $LiTaO_3$, $BiFeO_3$, $Na_xWO_3$, $Ba_2NaNb_5O_5$, $Pb_2KNb_5O_{15}$). Additionally some Polymer materials like rubber, wool, hair, wood fiber, and silk exhibit piezoelectricity to some extent and may be utilized. Additionally, the polymer polyvinylidene fluoride, ($—CH_2—CF_2—$), which exhibits piezoelectricity several times larger than quartz may be used.

The cleaning pad 28 may also include a portion of an unbonded web material, as described in U.S. Pat. No. 5,858,515, issued Jan. 12, 1999 to Stokes et al. and U.S. Pat. No. 5,962,112, issued Oct. 5, 1999 to Haynes et al. or other material such as described by U.S. Pat. No. 4,720,415, issued Jan. 19, 1988 to Vander Wielan et al. or any super absorbent material such as described in U.S. Pat. No. 4,995,133, issued February 1991 and U.S. Pat. No. 5,638,569 both issued to Newell, U.S. Pat. No. 5,960,508, issued Oct. 5, 1999 to Holt et al., and U.S. Pat. No. 6,003,191, issued Dec. 21, 1999 to Sherry et al.

In one embodiment, the cleaning pad 28 may comprise a spunbond fiber nonwoven web having a basis weight of approximately 68 grams per square meter. The spunbond fibers may comprise bicomponent fibers having a side-by-side configuration where each component comprises about 50%, by volume, of the fiber. The spunbond fibers will comprise first and second polypropylene components and/or a first component comprising polypropylene and a second component comprising propylene-ethylene copolymer or a polyester. About 1% or more or less of titanium oxide or dioxide is added to the fiber(s) in order to improve fiber opacity. The spunbond fiber nonwoven webs are thermally bonded with a point unbonded pattern. The nonwoven web is bonded using both heat and compacting pressure by feeding the nonwoven web through a nip foamed by a pair of counter-rotating bonding rolls; the bonding rolls comprise one flat roll and one engraved roll. The bonded region of the nonwoven web comprises a continuous pattern that corresponds to the pattern imparted to the engraved roll. Further, the bonded region is applied to the web when it passes through the nip. The bonded region will range between approximately about 27% to about 35% of the area of the nonwoven web and forms a repeating, non-random pattern of circular unbonded regions. Absorbency enhancing or superabsorbent materials, including superabsorbent polymers, powders, fibers and the like may be combined with the cleaning pad 28.

Alternatively, the pad 28 comprises a laminate of an air-laid composite and a spunbond fiber nonwoven web. The nonwoven web may comprise monocomponent spunbond fibers of polypropylene having a basis weight of approximately 14 grams per square meter. The air-laid composite may comprise from about 85% to about 90% kraft pulp fluff and from about 10% to about 15% bicomponent staple fibers. The bicomponent staple fibers may have a sheath-core configuration; the core component comprising polyethylene terephthalate and the sheath component comprising polyethylene. The air-laid composite has a basis weight between about 200 and about 350 grams per square meter and an absorbency of between about 8 and about 11 grams per gram.

The cleaning pad 28 may also include a portion or side of hydrophilic fibers useful for scrubbing. Additionally, nylon fibers may be used to increase the coefficient of friction when they become wet. Portions of the cleaning pad 28 may be composed of microfibers and ultra-microfibers having a denier per filament (dpf) less than or equal to about 1.0.

As described, the cleaning pad 28 can be formed by any material or material-forming process known, including woven and nonwoven materials, polymers, gels, extruded materials, laminates, layered materials which are bonded together integrally and thus form a co-material, fused materials, extruded materials, air laying, etc.

The cleaning pad 28 can alternatively be optimized for providing a cleaning fluid to the surface, such as with micro capsules or encapsulated fluids or agents. The enhanced surface of the cleaning pad 28 can have scrubbing or abrasive qualities. The enhanced surface can also be foamed by a mechanical stamping, bonding, pressing, compression, extrusion, sprayed, sputtered, laminated or other surface forming or affecting process. The various alternative cleaning solutions discussed above could be microencapsulated into the cleaning pad such that they are selectively released by some additional stimulus. It is understood that various cleaning solutions microencapsulated into the cleaning pad could be activated by water, another chemical in the fluid reservoir or pressure. The solutions could be dry impregnated. Alternatively, the chemical solutions could be encapsulated in pockets or bubbles on or within the pad 28 or on the cleaning media support 26. The pockets could be designed to burst and release the cleaning solution upon the application of moderate pressure.

In one other embodiment, the pad of the present invention does not contain strips or cut layers to hold down fibers from a fiber bundle. This is in direct contrast to the pad described, for example, in U.S. Pat. No. 6,813,801. The removal of the strips and/or cut upper cloth may allow for the presentation of a fluffier cloth. Such a cloth may also better contour a given surface without interference.

It should be understood that the cleaning system 20 may be presented with its component parts partially preassembled or unassembled. During assembly or manufacture of the cleaning system 20, the ears 49*a*, 49*b* of the preformed handle portion 24 described above can be forced to flex outward from each other as the pivot member 82 is inserted therebetween in the orientation described above. The axles 80*a*, 80*b* slide along the path defined by the grooves 52*a*, 52*b* until they reach the pivot holes 54 defined at the terminal end. Axles 80*a*, 80*b* fit within holes 54 thereby defining a pivot joint. The sleeves 110*a*, 110*b* of the cleaning pad 28 are then placed over the attachment members 108*a*, 108*b* securing the cleaning pad to the system.

The circular pivot member 82 accommodates rotational movement of the cleaning pad support member 26 in a range of about 55 to 65 degrees relative to the longitudinal axis of the handle portion 24. The preferred range is ideal for accommodating the alternate fiber lengths and cloth geometries of the inventive system. Particularly preferred is a range of about 61 degrees. When the cleaning pad support member 26 is fully extended in its cleaning position (FIG. 1), circular retention tabs 95 fit within retention tab holes 87 and maintain the cleaning pad support member 26 in its cleaning position.

FIGS. 1, 3, 4, and 10 illustrate the inventive cleaning system in its alternating positions. FIG. 1 illustrates the cleaning system 20 in its cleaning position. As described above, in the cleaning position the cleaning pad support member 26 extends forwardly, pivot engagement tab 38 engages the cleaning position notch 102 of pivot member 82, and retention tabs 95 fit within the retention tab holes 87. These engagement or retaining features create at least 2.5 lbf of pivot force. This amount of force is sufficient to maintain the cleaning pad support member 26 in its fully extending cleaning position despite any torque experienced during normal dusting, drying, or cleaning motions. Thus, in the cleaning position, a user may manipulate the cleaning system 20 via the handle portion 24. Additionally, the user may apply the water or other liquid housed within the fluid reservoir 30 directly onto the surface to be cleaned. The user may insert a finger through the opening 32 and depress the spray cap 61 thereby causing the discharge of the fluid housed within the reservoir 30. Due to the orientation of the cleaning system 20 in the cleaning position, the liquid will typically be applied directly to the surface to be cleaned in an area behind the cleaning pad 28 when the system is in a horizontal orientation such as when dusting a coffee table. Alternatively, a cleaning solution can be sprayed onto a vertical surface to be cleaned, such as a window or door molding.

Figure 4:
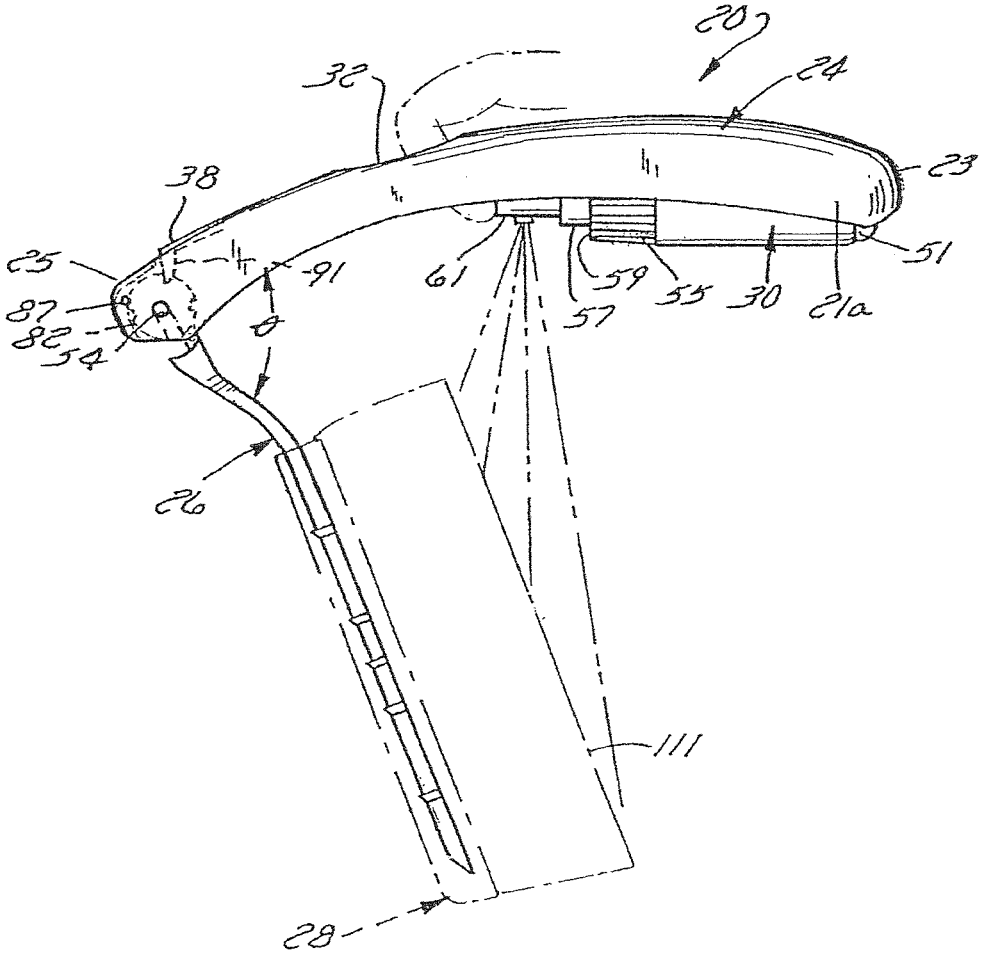
FIG. 4 is a side view of the cleaning kit in the liquid application position or 5 o'clock position with a cleaning pad support and a human finger shown in phantom.
Figure 10:
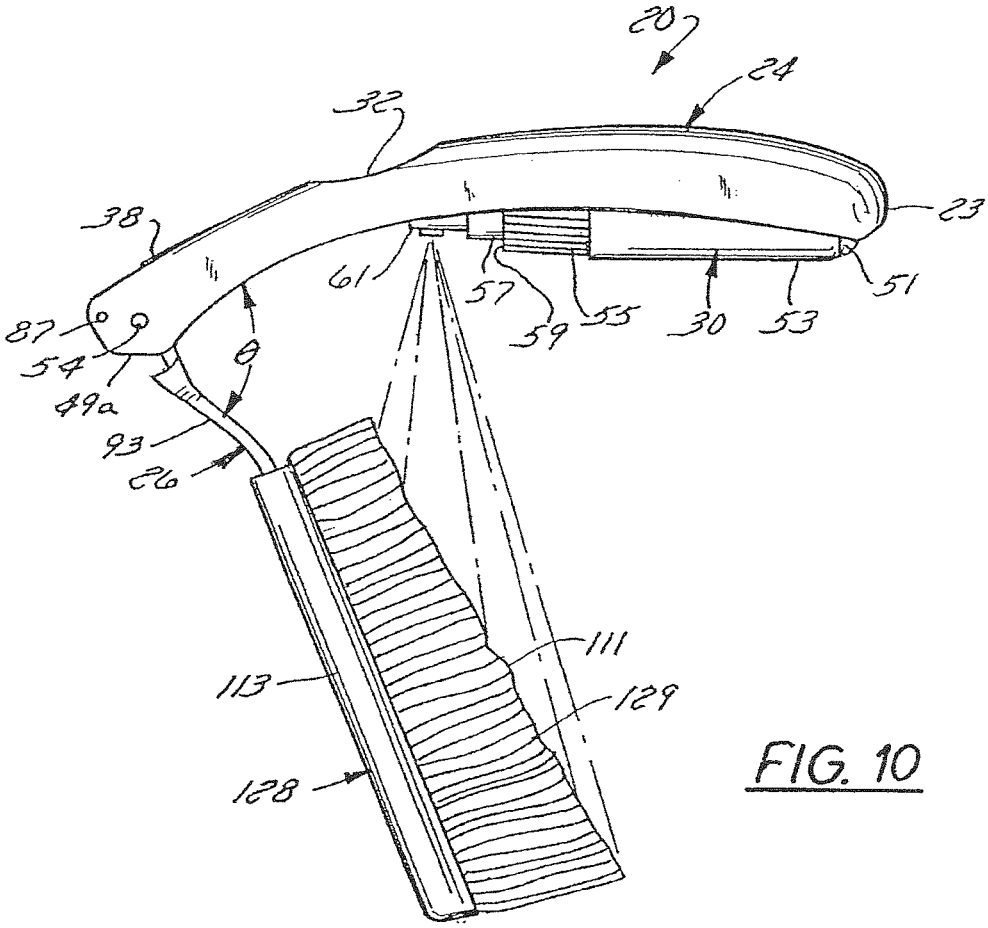
FIG. 10 is side view of a cleaning kit in the liquid application position further illustrating an alternative embodiment with a cleaning pad attached.

FIGS. 4 and 10 illustrate the cleaning system 20 in a second liquid application position. In order to move the cleaning pad support member 26 into the liquid application position a user must hold the handle portion 24 and apply torque to the cleaning pad support member 26 to move it from the cleaning position illustrated in FIG. 1. As sufficient torque is applied to overcome the forces of the inventive engagement features, the circular pivot member 82 rotates downwardly into the liquid application position. In the liquid application position, pivot engagement tab 38 engages the liquid application notch 104 of the pivot member 82 thereby holding the cleaning pad support member 26 is its angled liquid application state. In the illustrated embodiment, the angle Ø between the cleaning pad support member 26 and the handle portion 24 in the liquid application position may be between 45° and 68°. Preferably, the angle Ø between the cleaning pad support member 26 and the handle portion 24 is between 55° and 68° with 63° being particularly preferred. This preferred angle takes into consideration the spray pattern of the fluid reservoir (shown in phantom) in order to achieve liquid application onto the greatest surface area of the cleaning surface 111 of the cleaning pad 28.

During dusting or cleaning a user may repeatedly rotate the cleaning pad support member 26 from its cleaning position to its liquid application position as needed. Alternatively, as noted above, a user may simply apply liquid directly to the surface to be cleaned while using the cleaning system 20 in the cleaning position.

Figure 3:
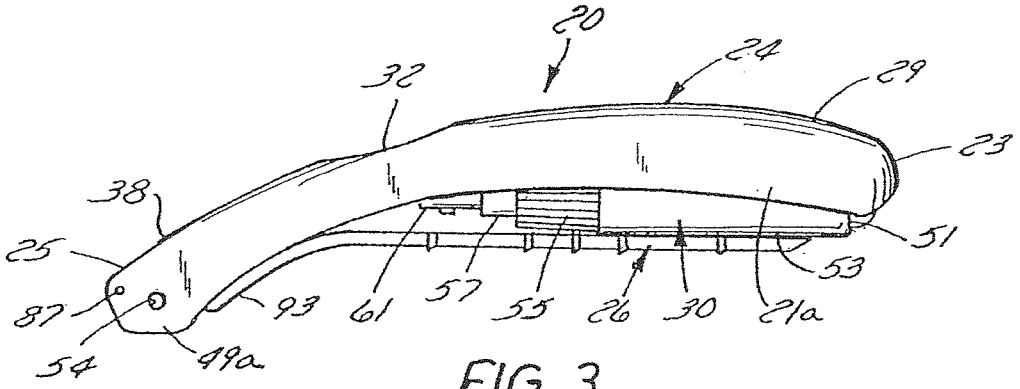
FIG. 3 is a side view of the cleaning kit in the storage position or 3 o'clock position.

FIG. 3 illustrates the storage position of the cleaning system. As illustrated in FIG. 3, in the storage position the cleaning pad support member 26 is rotated backwards such that it is generally parallel to the plane defined by the longitudinal axis of the handle portion 24. In the storage position, engagement tab 38 engages the storage position notch 106 thereby maintaining cleaning pad support member 26 in its folded position. In the storage position, the cleaning system 20 may be easily stored into a variety of spaces such as kitchen drawers or cabinets. Alternatively, the system can be hung on a wall using the opening 32 in the handle portion 24.

As it can be appreciated from the description above the invention includes a novel method of adjusting the cleaning pad support member 26. One first obtains the cleaning system 20. While holding the handle portion (and preferably no other portion of the device), one presses the cleaning pad support member 26 against an object (e.g. a wall or a floor) to cause rotation of the cleaning support member 26 relative to the handle portion 24. In an alternative embodiment, the pivot member may include a torsion spring or other biasing means to return the cleaning support member 26 to its cleaning position without effort on behalf of the user.

FIG. 10 illustrates an alternative embodiment of the cleaning pad 128 of the present invention. Cleaning pad 128 is similar to the pad previously described, however, pad 128 includes tapered fibers 129 on its cleaning surface 111. As illustrated in FIG. 10, fibers 129 are tapered in a manner such that those fibers 129 closest to the handle portion 24 are shortest. As one moves away from the handle portion 24, the fibers 129 become progressively longer in length. The tapered fiber length further accommodates the cleaning system 20 in achieving a maximum cleaning fluid application surface area on the cleaning surface 111, in the fluid application position.

Figure 12:
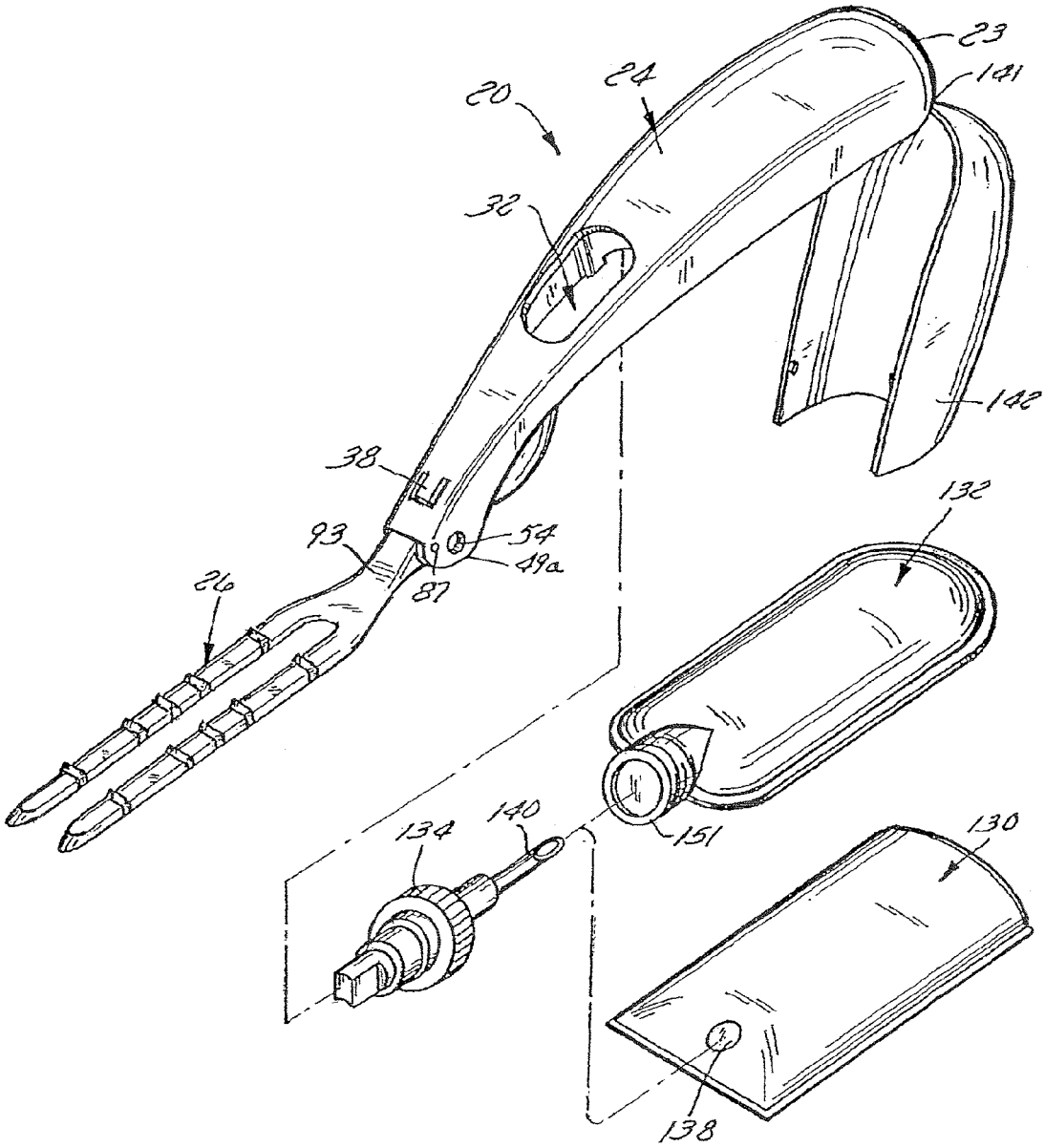
FIG. 12 is an exploded perspective view of the component parts of an alternative embodiment of a cleaning kit.
Figure 13:
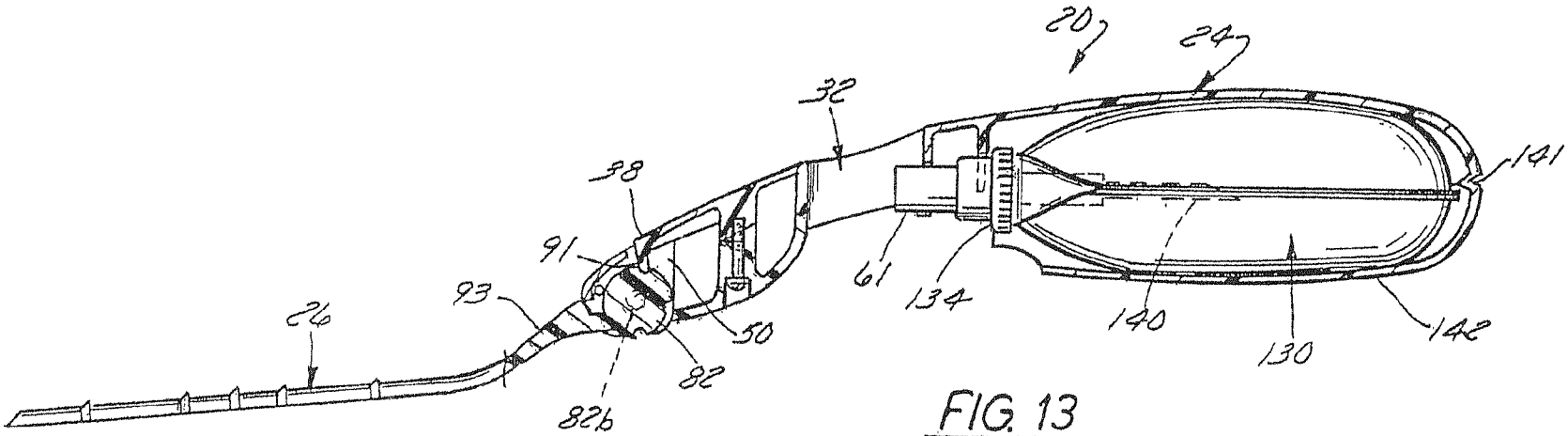
FIG. 13 is a vertical cross-sectional view of the alternative cleaning kit illustrated in FIG. 12 taken along the longitudinal axis of the kit.

FIGS. 12 and 13 illustrate an additional alternative embodiment of the cleaning system. As illustrated by FIGS. 12 and 13, the cleaning fluid reservoir 30 of the previous embodiment has been replaced with a flexible pouch 130. In the alternative embodiment, spray nozzle or cap 134, with an angled dip tube 140 may be retained in the handle portion 24 as previously described. A user may puncture the seal at a preformed location 138 on the pouch with the pump dip tube 140. Alternatively, a user may screw the spray cap 134 onto a threaded pouch fitment 151 or the spray cap 134 may be directly staked to the pouch 132 during the filling operation. As illustrated in FIGS. 12 and 13, the cradle of the previous embodiment has been replaced with a snap-fitting cover 142 attached via a living hinge 141 to the handle portion 24. Cover 142 secures the pouch 130 within the cleaning system 20.

A. Preferred Embodiments of the Cleaning Pad For Use In Wet Damp or Dry Dusting

FIGS. 14-24 illustrate preferred embodiments of the cleaning pad 28 that may be used with the inventive cleaning system 20. In the illustrated preferred embodiments, the cleaning pad 28 is generally comprised of a cleaning fiber mat 203 layered on one surface of a base sheet 202. The fiber mat 203 is preferably bonded to the base sheet 202 in the lengthwise direction of the fiber mat 203 along a central bonding region, e.g., line 204 extending continuously along the center of the base sheet 202. In addition, the fiber mat 203 is bonded to the base sheet 202 at spot bonding regions 207 defining discontinuous lines that run parallel with the central bonding line 204. As described in greater detail below, although the size of the fibers defining the fiber mat 203 of the cleaning pad 28 may vary depending on the application, it is preferable that the size of the fibers be between 1-18 denier.

Figure 14:
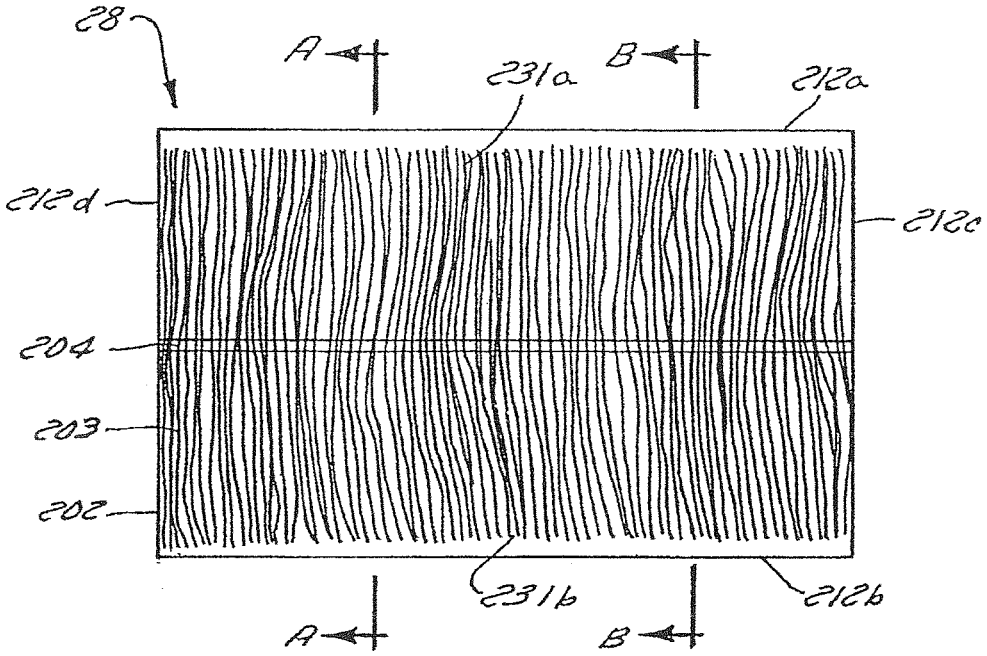
FIG. 14 is a bottom plan view of one preferred embodiment of the cleaning pad of the cleaning kit.
Figure 15:
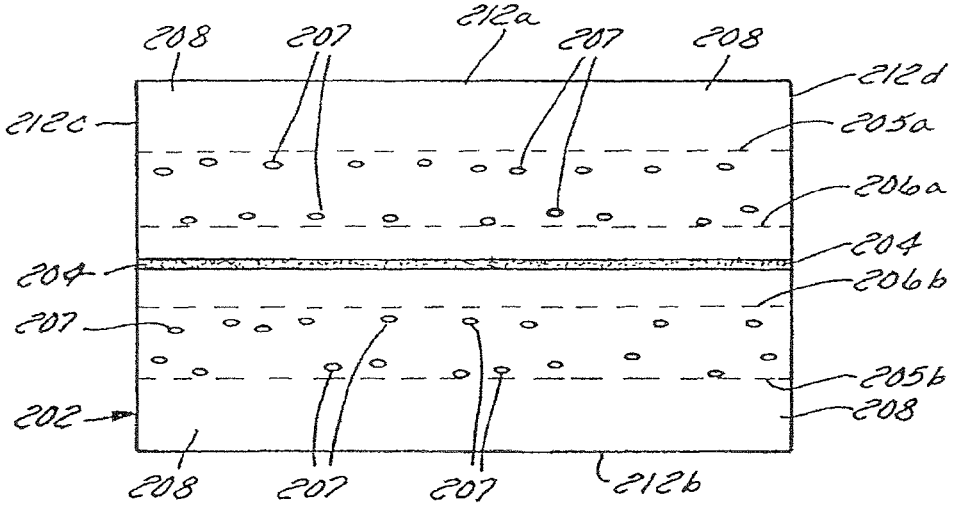
FIG. 15 is a plan view of a base sheet of the cleaning pad illustrating the preferred bonding regions.
Figure 16:
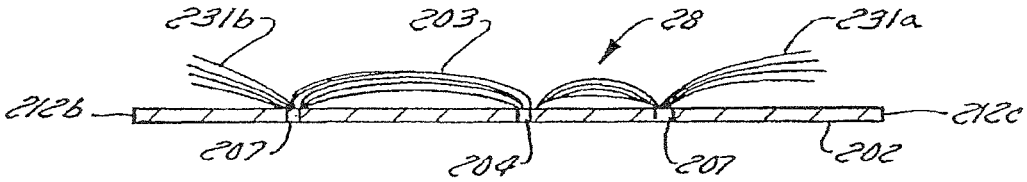
FIG. 16 is a cross-sectional view of the cleaning pad of FIG. 14 taken along line A-A.

Turning initially to FIGS. 14-16, a first preferred embodiment of the cleaning pad 28 of the present invention is illustrated. The cleaning pad 28 is formed by layering a fiber mat 203 on one surface of a base sheet 202. The base sheet 202 is preferably constructed from a nonwoven sheet or other equivalent as is known in the art. The base sheet 202 and fibers 203 are preferably bonded together along a central bonding line 204. In the illustrated embodiment, the central bonding line 204 extends from a first base sheet edge 212*c* to an opposed second base sheet edge 212*d*.

As illustrated in FIG. 15, in addition to the central bonding region 204, the fiber mat 203 and the base sheet 202 are bonded at a plurality of spot bonded regions 207. The spot bonded regions 207 generally define discontinuous parallel broken lines 205*a*, 205*b*, 206*a* and 206*b*. In the illustrated embodiment, the broken lines 205*a*, 205*b*, 206*a* and 206*b* are parallel to the central bonding line 204.

Figure 17:
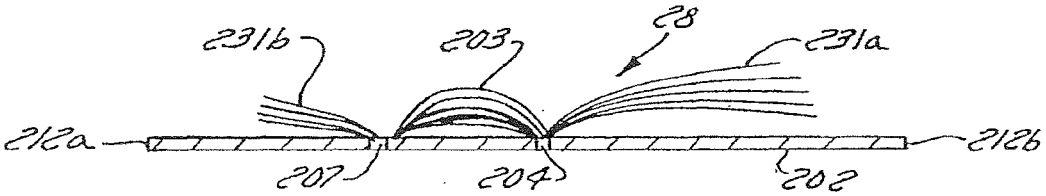
FIG. 17 is a cross-sectional view of the cleaning pad of FIG. 14 taken along line B-B.

The cross sectional views illustrated in FIGS. 16 and 17, better illustrate the bonding regions of fiber mat 203. The fibers of the fiber mat 203 generally extend freely between the central bonding line 204 and the edges 212*a*, 212*b* of the base sheet 202. However, portions of the fiber mat 203 are intermittently bonded to the base sheet 202 at the above-described spot bonding regions 207 (FIG. 16). Alternatively, FIG. 17 illustrates a section of the fiber mat 203 that is not bonded at a spot-bonding region 207 and extends freely from the central bonding line 204 to the end of the fiber 231*a*. Regardless of the orientation of the spot bonding regions 207, in the illustrated embodiments, the ends 231*a* and 231*b* of the fiber mat 203 are not bonded to the base sheet 202 and freely extend. The cleaning pad 28 is thus designed so fibers of the fiber mat 203 are free to move along lengths ranging from either the central bonding line 204 or the spot-bonded regions 207 to the ends 231*a* and 231*b*. Due to this unique bonding pattern between the fiber mat 203 and base sheet 202 (characterized by discontinuous spot-bonded regions 207 between the central bonding region 204) entanglements of the individual fibers is lessened and the cloth exhibits an overall fluffier appearance.

As best illustrated in FIG. 15, the spot bonded regions 207 generally define lines 205*a*, 205*b*, 206*a* and 206*b* that are parallel to the central bonding line 204. The individual spot bonded regions 207 are formed intermittently in a non-continuous linear fashion. The respective individual spot bonded regions 207 may be formed in a variety of shapes including circles, ellipses, ovals, straight lines, or the like. The spot bonded regions 207 may be formed such that the shapes of the spot bonded regions 207 are uniform, or, alternatively, the above shapes may be formed by a variety of combinations of the above shapes.

The width of the individual spot bonded regions 207 (along the lengths of the fibers) is preferably between 0.5-5 mm, and the length (in the lengthwise direction of the center bonding region) is preferably 2-15 mm. Each of the spot-bonded regions 207 is preferably spaced between 5-50 mm apart. It is understood that the spacing between the individual spot bonded regions 207 may be uniform throughout the entire range of the spot-bonded regions 207, or the spacing may vary in a variety of patterns.

In addition to the described orientation of the spot bonded regions 207, the spot-bonded regions 207 may be situated such that each of the spots alternates slightly to the left and right in the width-wise direction of the base sheet 202 (lengthwise direction of the fibers) with the parallel line as the center, so that the spot bonded regions 207 are positioned in zigzag patterns to the left and right with the parallel lines defining central lines. Thus, the spot-bonded regions 207 need not necessarily be lined up linearly above the parallel lines 205*a*, 205*b*, 206*a*, 206*b*.

It should be understood, that the spot-bonded regions 207 can be produced in other configurations, and are not limited to the above noted configuration. For example, the spot bonded regions 207 may define one parallel line between the central bonding line 204 and the edge 212*a* and one parallel line between the central bonding line 204 and the opposed edge 212*b*, so that they define only two parallel lines (e.g., 205*a* and 205*b*).

Alternatively, the spot bonded regions 207, could also define three parallel lines between the central bonding line 204 and edges 212*a*, 212*b*, such that they form a total of six parallel lines over the entire cleaning pad 28. Any number of lines could be formed, depending on the application.

The various spot bonded regions 207 do not overlap in the lengthwise direction of the fibers of the fiber mat 203, and thus bonding at multiple sites along the length of a single fiber does not occur. As a result, the majority of the length of the fiber on the fiber mat 203 is free. Because the fiber mat 203 is strategically unimpeded, this effectively prevents entanglement of the fibers of the fiber mat 203, while also allowing increased foreign matter trapping and retaining capacity to be maintained over a longer period of time.

Although the fibers of the fiber mat 203 can take a variety of lengths, in the preferred embodiment, the lengths of the fibers from the central bonding region 204 to the ends of the fibers in the lengthwise direction of the fibers is preferably 50-100% of the length from the central bonding region 204 to the edges (212*a* or 212*b*) of the base sheet 202. In one preferred embodiment, a cleaning pad includes a base sheet 202 with a width of 300 mm and a length of 200 mm. Preferably, the length from the central bonding line 204 to the edge of the base sheet 202 is 100 mm, and the length of the fibers of the fiber mat 203 is preferably between 50-100 mm.

As illustrated in FIGS. 16 and 17, the fiber ends 231*a* and 231*b* in the lengthwise direction of the fibers of the fiber mat 203 are not bonded to the base sheet 202, and the length of the fiber that is allowed free movement from the ends 231*a* or 231*b* of the fibers of the fiber mat 203 to the bonded regions varies from about 10-40 mm from the spot bonded regions 207 to about 50-100 mm from those fibers that are only bonded along the central bonding line 204. Preferably, the lines defined by the spot-bonded regions 207 are in the range of 10-40 mm from the edges (212*a* or 212*b*) of the base sheet 202.

As noted above, the material of the base sheet 202 may be a nonwoven cloth sheet, paper, synthetic resin sheet, or other known material. In the illustrated embodiment, the base sheet 202 is preferably a nonwoven cloth sheet capable of trapping various types of foreign matter. Preferably, the nonwoven cloth used for the base sheet 202, weighs between 10 to 200 g/m$^2$ and has a thickness of between 0.01-0.1 mm.

In the preferred embodiment, when a thermal-welded fiber is used for the fiber mat 203, it is preferable for the base sheet 202 to have thermal welding capacity conducive to bonding with the fiber mat 203. Likewise, when a nonwoven cloth sheet is used it is preferable that it be thermally weldable to the fiber mat 203. As noted above, examples of such thermally weldable short fibers include polypropylene, polyethylene, polyethylene terephthalate, polyester, rayon and other fibers or materials in which the fibers are present in a core-sheath structure or in a side-by-side structure, thus forming composite fibers.

The nonwoven cloth sheet that is used as the base sheet 202, may be a spunless nonwoven cloth, spunbonded nonwoven cloth, thermally bonded nonwoven cloth, air-through bonded nonwoven cloth, spot-bonded nonwoven cloth, or others. In the preferred embodiment, a spunless nonwoven cloth or thermally bonded nonwoven cloth is utilized. The nonwoven cloth sheet may be foamed from a single sheet, or may be formed by the lamination of multiple sheets of the same or different types.

The fiber mat 203 used in the cleaning pad 28 may be produced by overlaying multiple fibers so that they run in the same direction, or may be formed from a fiber aggregate. The fiber mat 203 is preferably in a sheet-form. In addition, the fiber mat 203 can be partially bonded by means of welding or the likes between the various fibers. The fiber mat 203 may include uniform fibers throughout, or may be constituted from multiple types of fiber.

The fiber mat 203 may also be manufactured from fibers having the same, or multiple thicknesses. Likewise, the fiber mat 203 can be formed from an aggregate in which fibers of different color are used, regardless of whether the thicknesses and types of the constituent fibers are the same or different.

As noted above, a wide variety of fibers may be used in the fiber mat 203 including cotton, wool and other natural fibers, polyethylene, polypropylene, polyethylene terephthalate, nylon, polyacrylic, polyesters, rayon and other synthetic fibers, core/sheath fibers, sea-island type fibers, side-by-side fibers and other composite fibers. Synthetic fibers and composite fibers are preferred due to their thermal welding properties. In one preferred embodiment, the tow is a bi-component fiber consisting of a core that has a higher melting point than the sheath. For example, in one embodiment the tow is a bi-component fiber consisting of a polypropylene core and a polyethylene outer surface or sheath. This is particularly preferred, because both materials have superior thermal welding properties. In addition, the fibers used for the fiber mat 203 may be formed from a crimped material produced by mechanical crimping or thermal crimping.

In one preferred embodiment, the fiber mat 203 may be a long fiber mat generally referred to as "tow," which is manufactured from polyethylene, polypropylene, nylon, polyester, rayon, or similar materials. The thickness of the fibers that constitutes the fiber mat 203 is preferably between 1-18 denier. In addition, the weight of the fiber mat 203 is preferably between 5-30 g/m$^2$ when the thickness of the fibers is about 2 denier.

The cleaning pad 28 of the present invention can be obtained by layering the fiber mat 203 on the surface of the base sheet 202, and then bonding the two along the central bonding line 204 and spot-bonded regions 207 as previously described. This can be accomplished by thermal welding, ultrasonic welding, bonding, contact, or other known method.

In the preferred embodiments, the base sheet 202 and fiber mat 203 are formed from thermally weldable materials, and the laminate of the base sheet 202 and fiber mat 203 are heated and compressed with a hot roll to bond the two surfaces together. Alternatively, if the base sheet 202 or fiber mat 203 are not weldable, a thermally bondable material such as hot melt adhesive can be laminated between them, or bonding can be carried out by directly applying an adhesive between the two layers.

As discussed above, the fiber mat 203 or base sheet 202 may be coated with a chemical agent for improving foreign matter trapping performance. Examples of such chemical agents include liquid paraffin and other mineral oils, silicone oils and nonionic surfactants.

In one preferred embodiment, the dust adhesion of the cleaning pad 28 is improved preferably by the addition of a composition or compound including an additive exhibiting amphiphilic properties. A variety of materials could be used to deliver amphiphilic properties to the cleaning pad. For example anionic, cationic, amphoteric and zwitterionic surfactants could be added to the cleaning pad. Solvents with hydrogen bonding character, other organic molecules with ionized or ionizable polar head groups could also be used.

The active ingredients of the amphiphilic additives could be chosen from, for example, aldehydes, alcohols, surfactants, silicones, carbon acids or amines. A variety of combinations of the noted materials could be utilized. Surfactants which are liquids could be used alone, however, surfactants that are solids must be mixed with a non-volatile solvent, such as IPA or other alcohols including polyalcohols and glycol-ether solvents (for example; propylene glycol and ethylene glycol N-hexyl ether), functionalized or non-functionalized silicones, carboxylic acids which can act as surfactants, monoethanol amine (pH control and basic solvent) and aldehydes (for example formaldehyde as a preservative, or acetaldehyde). The preferred amphiphilic additives can be used either alone as a separate treatment, or in combination with a mineral oil material on the cleaning pad 28. Examples of preferred additives include disodium cocoamphodiacetate, (for example), Mackam™ 2CSF manufactured by McIntyre Group, Ltd. or disodiumdecyl(sulphonatophenoxy)benzenesulfonate. Cationic surfactants could include those found in fabric softener such as Bounce® sheets or Downy® liquid. Other cationic surfactants include Quat 2125M, Tegopren 6922, quaternium 80 (Degussa Chemical Company), or Tego Polish Additive Q70 (Degussa Chemical Company).

The amphiphilic additive may be impregnated directly on the duster and/or delivered/impregnated in a formulation together with solvents (water, alcohols, etc.) to the cleaning pad 28 or a surface to be cleaned by a user. Many known methods can be used to apply the additive to the cleaning pad 28 during manufacture. Examples include, spraying, wicking, gravere rolling and dipping. If applied at manufacture, the individual cleaning pads 28 could be stored in a plastic or cellophane sleeve.

Alternatively, the additive could selectively applied to the cleaning pad 28 or the surface to be cleaned by a user. For example, the additive could be applied by a user via a spray bottle, an aerosol can or other known dispenser. In the illustrated embodiment, the additive could be included in the preferred fluid reservoir 30 of the cleaning system 20 and be used to selectively apply the additive to a surface to be cleaned and directly to the fiber mat 203 of the cleaning pad.

During testing, increased dust pick up was measured by dusting a known soiled table top with a "dry" cleaning pad and with a cleaning pad having amphiphilic additive applied and then weighing the amount of soil attached to each duster. The amount of soil attached to the duster is the increase in weight compared to the dry duster prior to dusting. This measurement may be referred to as the "% dust pick up." In the preferred embodiment, the cleaning pad with the amphiphilic additive exhibited on average an increased % dust pick up of 25% percent when compared to a duster with just mineral oil. A maximum increase of 68% increased dust pick up was achieved.

In another embodiment, the cleaning pad 28 is preferably impregnated with a volatile liquid or additive for improved soil removal with a minimal residue left on the surface to be cleaned. The additive is preferably selected from materials, which evaporate quickly during and after the dusting process. The quick evaporation rate leaves little residue and a desirable appearance for a consumer on the dusted surface.

A wide variety of ingredients can be used to form the volatile additive for impregnating the cleaning pad 28. Blends and combinations of known low residue cleaners including those previously described could be utilized. Useful formulations would include both aqueous and non-aqueous formulas. It is preferred that the vapor pressure of the solvent of the additive be between 0 kPa to 10 kPa. Solvents in this range provide rapid evaporation of wetness during and after use. More preferred are solvents with a vapor pressure between 0.01 to 10 kPa. Particularly preferred are solvents with a vapor pressure around 1 kPa. Some known solvents include water (vapor pressure about 2 kPa), isopropanol (vapor pressure about 6 kPa) and propylene glycol n-butyl ether (vapor pressure about 0.1 kPa).

The additive can be a solution, micellar solution, microemulsion or regular emulsion with sufficient stability. Simple solutions, micellar solutions and microemulsions are preferred because of their clarity and stability. Aqueous solutions preferably have a large level of water in the formula.

Many known methods can be used to apply the volatile additive to the cleaning pad 28 during manufacture. Examples include, spraying, wicking, gravere rolling and dipping. Due to the preferred volatile nature of the additive, the individual cleaning pads 28 are preferably stored in a plastic or cellophane sleeve or container to prevent premature evaporation of the additive. The volatile may also be sprayed on the pad from a bottle. Alternatively a polyethylene tub or tube could be used to store the loaded cleaning pad. This is particularly desirable for cleaning pads impregnated with an additive having a vapor pressure of less than 0.1 kPA.

It should be understood that the volatile additive can be combined with many of the previously described additives or cleaning fluids. For example and in no way limiting, the volatile additive could be combined with surfactants, fragrances, dyes, amphiphilic additives and other additives. Likewise, a plurality of cleaning pads impregnated with such additive could be housed in a resealable plastic container.

When the preferred cleaning pad is incorporated into the preferred cleaning system 22, the fiber mat 203 is laminated onto one side of the base sheet 202 and bonded at a central bonding line 204. In addition, bonding is carried out at spot-bonded regions 207 formed discontinuously along parallel lines between the two edges 212*a* and 212*b* parallel to the center-bonding region 4. Thus, a cleaning pad 28 is formed in which the two ends in the lengthwise direction of the fibers of the fiber mat 203 are not bonded to the base sheet 202.

Figure 18:
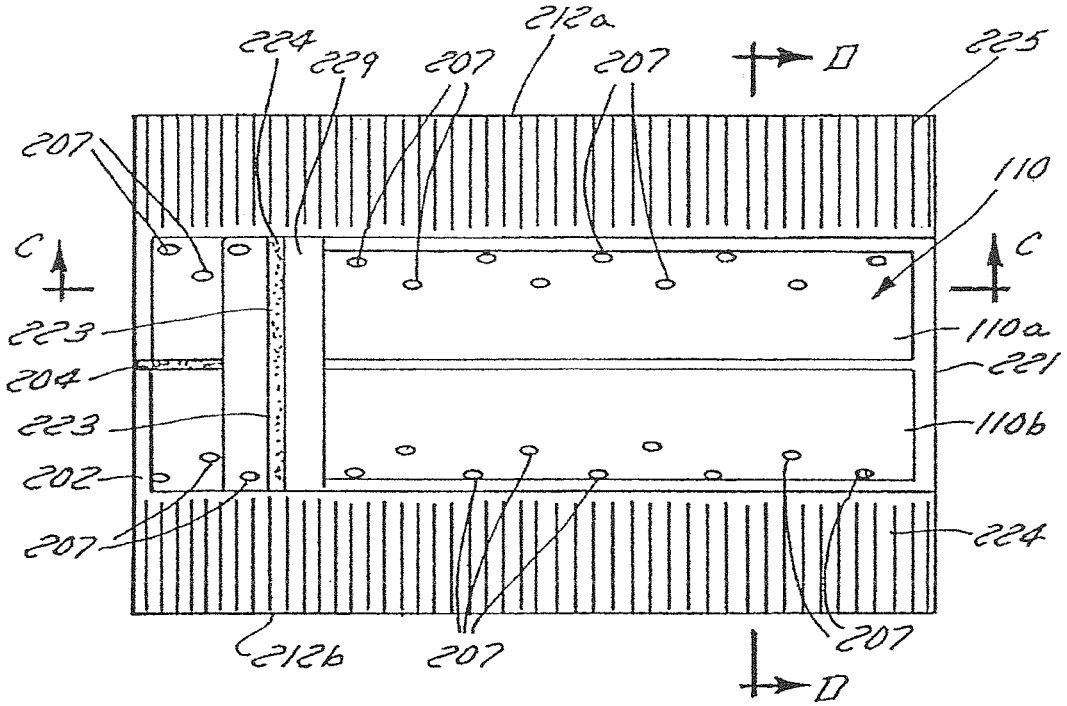
FIG. 18 is a top plan view of another preferred cleaning pad.
Figure 19:
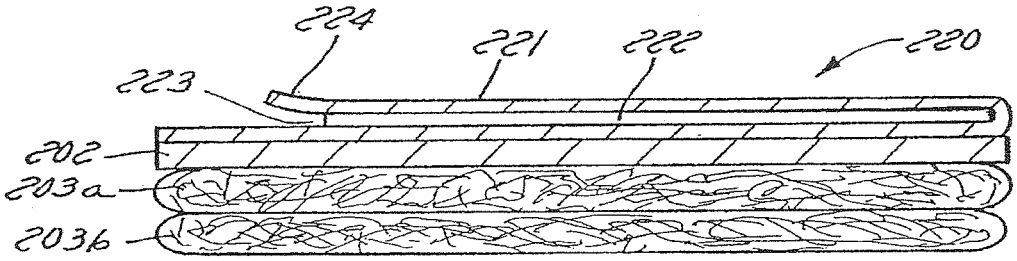
FIG. 19 is a cross sectional view of the cleaning pad of FIG. 18 taken along line C-C.
Figure 21:
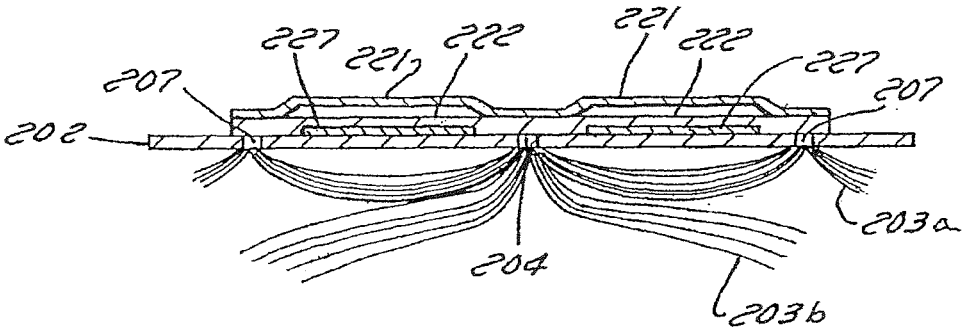
FIG. 21 is a cross-sectional end view of the cleaning pad illustrated in FIG. 18 taken along line D-D.

As illustrated in FIGS. 18, 19 and 21 pockets or sleeves 110 of the cleaning pad 28 are formed by laminating and bonding a retaining sheet 221 on the back surface of base sheet 202 (opposite the fiber mat 203), thereby forming a retaining opening 222 consisting of space whereby the arm of the attachment members 108*a*, 108*b* of the cleaning tool 22 can be inserted and retained. In one embodiment, the retaining sheet 221 is bonded to the base sheet along the central bonding line 204 and spot bonding regions 207 used to bond the fiber mat 203 to the base sheet 202 thereby defining two sleeves 110*a*, 110*b*. The retaining sheet 221, need not be bonded along the same lines as the fiber mat, and may take a variety of configurations so long as it defines a retaining opening 222.

As best illustrated in FIG. 18, base sheet 202 of the cleaning pad 28 may also be provided with numerous cuts or fringes 225 that are cut in the same direction as the lengthwise direction of the fibers of the fiber mat 203. The fringes 225 increase the surface area of the cleaning pad 28 and improve dust adhesion.

Figure 20:
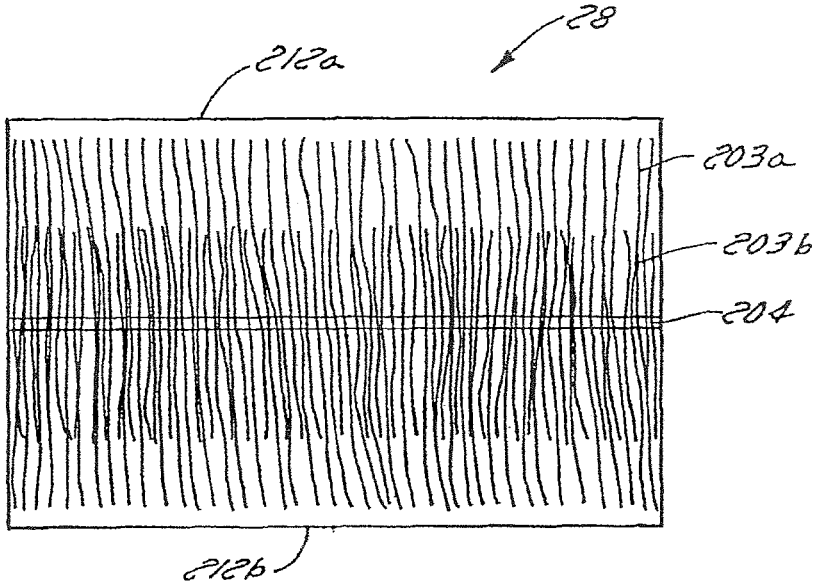
FIG. 20 is a bottom plan view of the cleaning pad illustrated in FIG. 18.

FIGS. 19-21 illustrate another preferred embodiment of the cleaning pad 28 wherein the fiber mat 203 is formed by superimposing two or more fiber mats 203*a*, 203*b* constructed from different types of constituent fibers, different fiber sizes or different colors. Superimposing the various fiber mats provides for a cleaning pad 28 having different properties. In one preferred embodiment, a fiber mat 203*a* with thinner fibers alternates with a fiber mat 203*b* of thicker fibers. For example, a fiber mat with a size of 0.01-0.05 mm is preferred for the thin mat 203*a* and a fiber mat with a size of 0.06 mm-0.3 mm is preferred for the thick mat 203*b*. In addition, it is preferable to use a fiber with high stem strength such as polypropylene or nylon for the thick fiber mat 203*b*. The thick fiber mat 203*b* is preferably constructed from bunched fibers formed by splitting drawn polypropylene tape in the direction of drawing. The thick polypropylene fiber mat 203*b* is preferably only bonded only at the central bonding line 204 to the preferred thin mat 203*a* formed from bicomponent tow fiber consisting of a polypropylene core and a polyethylene outer surface. Thus, as illustrated in FIG. 21, the thick fiber mat 203*b* hangs freely from the cleaning pad 28. As a result, the fiber pad appears bulkier or fluffier.

The dual fiber mat 203 may be produced by laminating the thin sheet 203*a* to the base sheet 202 as described in reference to FIGS. 14-17. The thick fiber mat 203*b* is then layered over the thin fiber mat 203*a* and bonded along the center bonding line 204.

Although the layering of alternative fibers in the fiber mat can be carried out in a variety of ways, in the illustrated embodiment the thick fibers 203*b* are on the exterior (on the side of the surface to be cleaned). This arrangement works particularly well for cleaning surfaces or appliances that include fine gaps such as a computer keyboard. The thin fibers 203*a* do not have body, and so they tend not to enter into the gaps. In contrast, however, the thick fibers 203*b* exhibit greater stem strength, and as a result they more easily enter into the gaps, allowing dust, dirt and other foreign matter to be lifted off the surface to be cleaned. In addition, thick fibers 203*b* serve to prevent entanglement of the narrow fibers and as well as provide a rougher surface to remove debris stuck to a surface.

In one embodiment, the length of the thick fiber mat 203*b* in the lengthwise direction of the fibers is preferably somewhat shorter than the length of the thin fiber mat 203*a*. However, the lengths may vary depending on the application.

Figure 22:
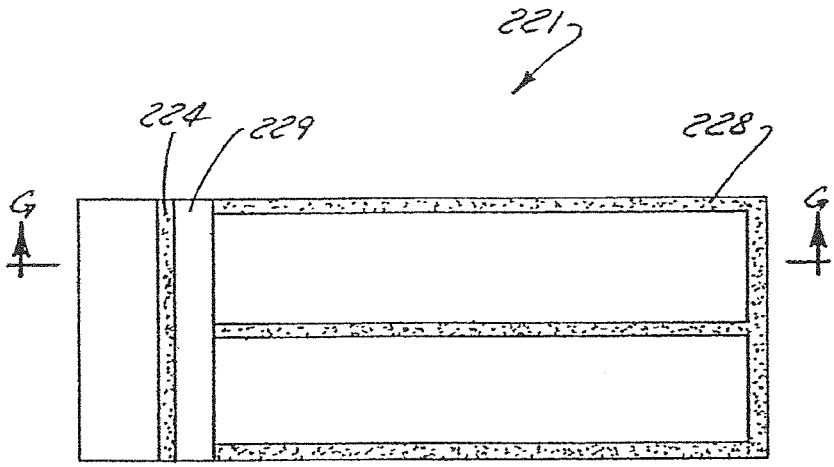
FIG. 22 is a top plan view of one embodiment of a retaining sheet for use with the cleaning pad.
Figure 23:
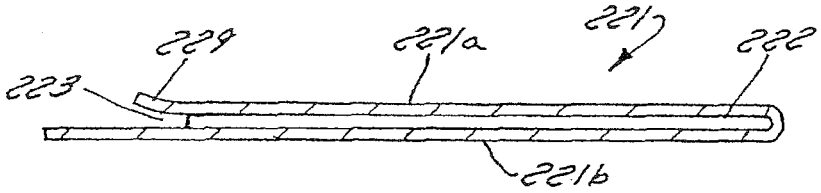
FIG. 23 is a cross sectional end view of the retaining sheet taken along line G-G of FIG. 22.
Figure 24:
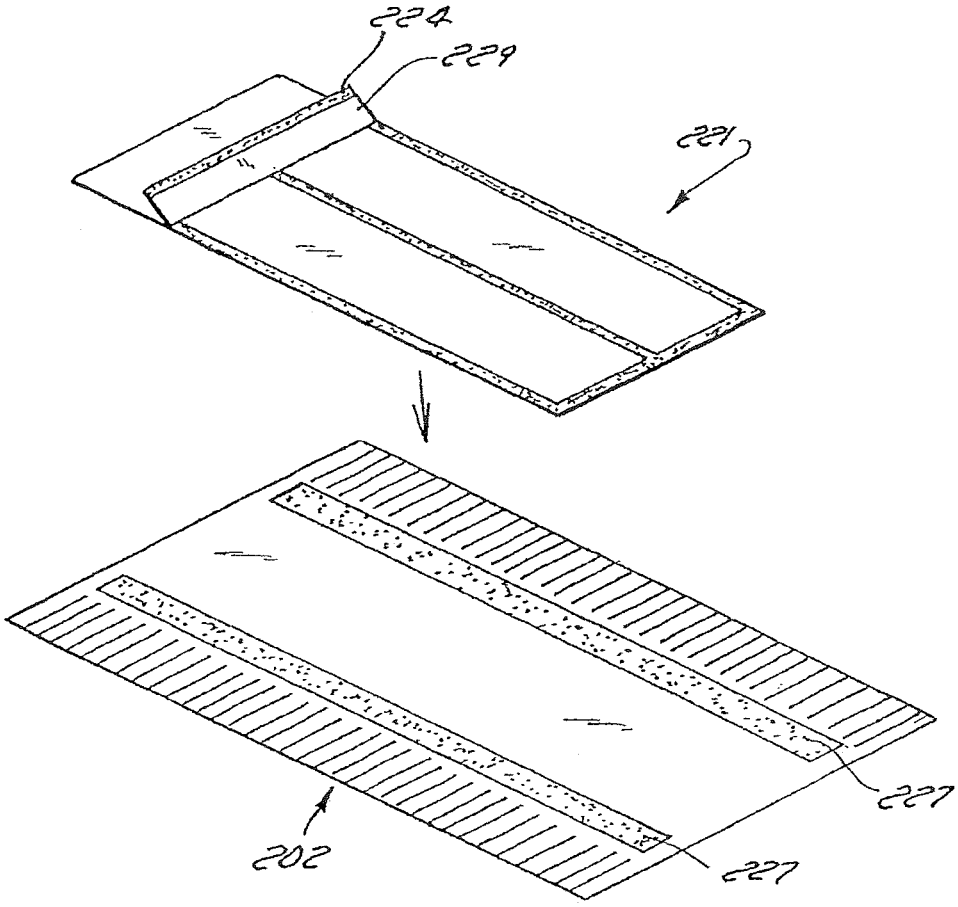
FIG. 24 is a perspective view of the placement of the retaining sheet onto a base sheet of the cleaning pad.

FIGS. 22-24 illustrate another preferred embodiment of the cleaning pad 28, or more particularly the retaining sheet. The retaining sheet 221 of cleaning pad 28 is produced by laminating two sheets of nonwoven cloth 221*a* and 221*b*, heat-sealing and bonding the center and three sides, to define an insertion opening 223. A sack-form retaining part 222 consisting of a space for inserting and retaining the attachment members 108*a*, 108*b* is formed between the two nonwoven cloths 221*a* and 221*b*.

As illustrated in FIG. 23, the insertion opening 223 of the retaining sheet 221 is formed. The retaining sheet 221 shown in FIG. 24 may alternatively be produced by folding a single nonwoven cloth in two, and heat-sealing prescribed locations thereof, to create an insertion opening 223. The upper nonwoven cloth 221*a* is formed so that it can curve freely upwards at the edge of the sealed region 228 and thus functions as a border 229 that is not bonded to the nonwoven cloth 221*b* underneath.

In one preferred embodiment, a colored region or other indicia 224 may be provided at the end of the border 229 indicating the orientation of the insertion region 223. Thus, when the upper nonwoven cloth 221*a* is made longer than the lower nonwoven cloth 221*b* and the border 229 is provided, insertion of the attachment members 108*a*, 108*b* can be carried out easily and smoothly.

As an alternative to providing a colored part as the indicia 224 on the border 229 of the retaining sheet 221, an embossing process can be carried out in order to provide a raised pattern at the same location. By providing indicia or on the insertion opening side 223 of the retaining sheet 221 the area where the attachment members 108 are to be inserted can be readily identified.

As illustrated in FIG. 24, the retaining sheet 221 is attached to the base sheet by 202 by applying hot-melt adhesive 227 in the center of the base sheet, and then laminating and heating the above retaining sheet 221 and base sheet by a means such as heating or compression welding. Affixing of the retaining sheet 221 to the cleaning pad 28 may be carried out using adhesive or pressure-sensitive adhesive, as well as hot melt adhesive.

Attachment of the cleaning pad 28 to the attachment members 108 is preferably carried out by inserting the attachment members 108*a*, 108*b* into the insertion opening 223 of the retaining sheet 221 so that it is retained in the retaining part 222. When the cleaning pad 28 becomes soiled, the arm attachment members 108 are pulled out of the insertion opening 223, and a fresh cleaning pad 28 is put in place.

Due to the combination of the bonding of the fiber mat 203 at a central bonding line 204 as well as spot-bonded regions 207, and because the ends of the fibers of the fiber mat 203 in the lengthwise direction are not bonded to the base sheet 202, the fibers of the disclosed fiber mat 203 are highly napped in comparison to prior art cleaning pads, allowing the formation of a voluminous region of the fibers. This provides a significant advantage over the less voluminous cloths of the prior art. Both ends in the lengthwise direction of the fiber mat 203 of the sheet hang downwards, so that the tips of the fibers at both fiber ends are released from the base sheet and are free to move. As a result, the disclosed fiber mat 203 has superior trapping performance and retention capacity with respect to dust, dirt and various types of foreign matter relative to conventional sheets for cleaning implements in which long fiber filaments are cut and then napped at the surface or sandwiched between two carrier sheets.

The above-described preferred embodiments of the cleaning pads 28 are particularly well suited for the inventive system 20 that is capable of either wet, damp or dry cleaning or dusting. Known prior art cleaning pads and more particularly dusting pads have been hydrophobic. As a result, the prior art cleaning pads are not capable of using the inventive advantages of the use of low levels of a liquid product.

The present cleaning pad allows for an inventive wet damp or dry dusting method. In particular, the inventive system 20 uses a low level of liquid product combined with a dry dusting or cleaning pad 28 to increase dust removal. In the preferred embodiment the liquid level used is between 0.01 to 0.3 g/sq.ft. Alternatively, the preferred liquid level applied to the cleaning pad is between 80 and 500 micro liters. Particularly preferred is a range of between 120 to 130 micro liters. As described throughout the application the liquid could be water, a solvent or emulsion-based intermediates.

B. Methods of Use and Methods of Cleaning

It should be appreciated from the above disclosure that the preferred cleaning tool 22 can be utilized to clean or dust a variety of surfaces. Due to the configuration of the tool 22, a user can conveniently alternate between wet, damp or dry cleaning or dusting. It is recognized that the component parts of the invention may be conveniently interchanged depending on the particular cleaning task at hand. For example, some of the disclosed cleaning pads 28 may be more suitable for use with some of the disclosed cleaning solutions or for dry dusting. Likewise, some cleaning pads 28 may include alternate surfaces configured for alternative cleaning tasks. Similarly, the particular cleaning solution utilized can be changed depending on the desired application.

In order to perform dry dusting, a user may obtain the above-mentioned cleaning system 20 that includes the preferred cleaning tool 22. A user holds the cleaning tool 22 such that the palm of the user's hand surrounds the handle portion 24. In the preferred embodiment, the palm of a user's hand extends over the top 29 of the handle portion 24 and the user's fingers extend at least partially around the fluid reservoir 30. However, it is recognized that in performing dry dusting tasks, the fluid reservoir 30 need not be present. (For example, such a tool is illustrated in U.S. App. Pub. No. 2004/0034956 A1.) In the illustrated embodiment, a user's hand is typically orientated in a manner such that a user may insert his or her index finger through the hole 32 extending through handle portion 24.

Once the user obtains the tool 22, a user then places the cleaning pad 28 onto the cleaning pad support member 26. As noted above, the cleaning tool may be used with a variety of alternative cleaning pads 28. In the preferred embodiment, the sleeve-like cleaning pad 28 is mounted over the attachment members 108*a*, 108*b* so that all of the retaining tabs 112 are within the sleeves 110*a*, 110*b*. Once secured, the user then positions the cleaning pad 28 onto a surface to be cleaned and moves the cleaning pad 28 on the surface to be cleaned. The movement of the cleaning pad 28 across the surface to be cleaned causes dust or other debris to be collected by the cleaning pad 28. In the illustrated embodiment, dust or other debris is collected by the cleaning surface 111 of the cleaning pad 28. The user may, depending on the surface to be cleaned, pivot the cleaning pad support member 26 to accommodate hard to reach places. For example, if a user desires to dust an overhead lintel, the user may pivot the cleaning pad support member 26 to an angle of about 90° in relation to the handle portion 24.

A preferred dusting or cleaning pattern consists of a side to side overlapping motion starting in the upper left hand (or right hand) side of the section to be cleaned, and progressing the wiping pattern across the surface to be cleaned while continuing to use side to side wiping motions. Another preferred wipe pattern consists of an up-and-down wiping motion. The preferred wiping patterns allow the cleaning pad 28 to loosen dirt and dust, and provide a better end result. Another benefit of the above wiping patterns is minimization of streaks as a result of improved spreading of solution (in wet dusting).

It is recognized that wet dusting or cleaning can be done separately from, in conjunction with, or in addition to dry dusting. For example, a user may perform an initial dry dusting run and then proceed with wet dusting or cleaning. In the context of wet cleaning or dusting, similar steps are performed to those described above in the context of dry dusting. However, if necessary, the cleaning fluid reservoir 30 is preferably initially inserted into the fluid reservoir-receiving cradle 36. The fluid reservoir 30 is inserted between the handle portion sidewalls 21*a*, 21*b* and within the two U-shaped supports or rails 44 and 46. The fluid reservoir 30 is press fit into the cradle such that the triangular retention tabs 42*a*, 42*b* frictionally engage and retain the lower sidewall 53 of the fluid reservoir 30. The reservoir should be press fit such that the first bottleneck receiving support 44 fits around the fluid reservoir 30 near the junction 59 of the second 55 and third 57 sections of the reservoir 30. The second U-shaped spray cap receiving support 46 fits around, retains and orientates the spray cap 61 of the fluid reservoir 30. The spray cap receiving support flanges 71*a*, 71*b* press fit around flats 63*a*, 63*b* of fluid reservoir spray cap 61 when the reservoir is placed within the cradle 36. The tight fit defined by flanges 71*a*, 71*b* and flats 63*a*, 63*b* serves to properly orientate spray cap 61 within the fluid reservoir-receiving cradle 36 such that spray cap 61 faces in a direction away from the cradle 36.

During wet dusting or cleaning a variety of techniques may be employed consisting of combinations of wetting the surface and moving the cleaning pad 28 across the surface to be cleaned, wetting the cleaning pad 28 and moving the cleaning pad 28 across the surface to be cleaned, or a combination thereof.

FIG. 1 illustrates the cleaning system 20 in its cleaning position that is configured for wet cleaning wherein the cleaning solution is applied directly to the surface. As described above, in the cleaning position the cleaning pad support member 26 extends forwardly, pivot engagement tab 38 engages the cleaning position notch 102 of pivot member 82, and retention tabs 95 fit within the retention tab holes 87. In this position, the user may apply the water or other liquid housed within the fluid reservoir 30 directly onto the surface to be cleaned. The user may insert a finger through the opening 32 and depress the spray cap 61 thereby causing the discharge of the fluid housed within the reservoir 30.

FIG. 4 illustrates the cleaning system 20 in a second liquid application position. In order to move the cleaning pad support member 26 into the second liquid application position a user holds the handle portion 24 and applies torque to the cleaning pad support member 26 to move it from the cleaning position illustrated in FIG. 1. As sufficient torque is applied to overcome the forces of the inventive engagement features, the circular pivot member 82 rotates downwardly into the liquid application position. In the second liquid application position, pivot engagement tab 38 engages the liquid application notch 104 of the pivot member 82 thereby holding the cleaning pad support member 26 is its angled liquid application state. In this position, the user may apply the water or other liquid housed within the fluid reservoir 30 directly onto the cleaning surface 111 of the cleaning pad 28. As noted above, the various cleaning positions may be used interchangeably. During dusting or cleaning a user may repeatedly rotate the cleaning pad support member 26 from its cleaning position to its liquid application position as needed. During wet dusting or cleaning, the user may use the above noted cleaning pattern.

Once the cleaning or dusting has been finished, the user may remove and dispose of the cleaning pad 28 and place the cleaning system 20 into its storage position (FIG. 3). To place the cleaning system 20 into the storage position, the cleaning pad support member 26 is rotated backwards such that it is generally parallel to the plane defined by the longitudinal axis of the handle portion 24.

As noted above, a variety of cleaning solutions can be used with the inventive cleaning system. In one preferred method of cleaning or dusting, a solution comprising 96.30% by weight tap water, 1% isoparaffinic hydrocarbon, 1% silicone fluid, 0.5% sorbitan laurate, 0.5% polyoxyethylene sorbitan monolaurate, 0.155 myristalkonium chloride and quaternarium 14, 0.30% takasago TN-7962 and 0.25% formaldehyde is utilized. This composition is ideally suited for dusting jobs. Use of the preferred solution with the inventive cleaning solution provides an increase in dust and allergen retention as well as providing an improved shine to the surface to be cleaned. Fingerprints, smudges and other blemishes are also easily removed.

In another preferred embodiment, a cleaning solution includes 96.5125% by weight deionized water, 1.75% propan-2-ol anhydrous, 0.40% ethylene glycol monobutyl ether, 0.40% ethylene glycol n-hexyl ether, 0.125% propylene glycol, 0.10% monoethanolamine, 0.30% vinegar (white distilled 300 grain), and small amounts surfactants and other ingredients.

In another preferred embodiment, the cleaning solution includes 97% de-ionized water, 1.50% anhydrous propan-2-ol, 0.30% ethylene glycol N-hexyl ether, 0.13% industrial grade propylene glycol, 0.08% of a surfactant, 0.30% Mackam™ 2CSF, 0.10% monoethanolamine, and small amounts surfactants and other ingredients.

In still another preferred embodiment, the cleaning solution includes 91.8% de-ionized water, 5.0% isoparaffinic hydrocarbon, 0.25% elfugin AKT, 0.15% sodium n-cocoyl sarcosinate, 2.0% silicone fluid, 0.15% sorbiatnmono oleate, 0.15% polyoxyethylene sorbitan monolaurate, 0.15% low freeze grade triethanolamine, 0.15% formaldehyde, and small amounts of other ingredients.

In another embodiment, the cleaning solution includes 92.32% de-ionized water, 5% isoparafinic hydrocarbon, 2% silicone fluid, 0.15% sorbitan mono oleate, 0.15% polyoxyethylene sorbitan monolaurate, 0.03% triethanolamine, 0.15% formaldehyde, and small amounts of other ingredients.

It is important to control dosing and coverage of the cleaning solution. In one preferred embodiment, the liquid level that should be used with the preferred cleaning pad via application to the cleaning surface is between 0.01 to 0.3 g/sq. ft. or one "pump" of the spray mechanism. Alternatively, the preferred liquid level applied directly to the cleaning pad is between 80 and 500 micro liters. Particularly preferred is a range of between 120 to 130 micro liters. For best results, the product is applied at the above-recommended doses, onto the surface to be treated or onto the cleaning pad 28 and the cleaning pad 28 is then moved across the surface collecting dust and absorbing the cleaning solution if applied directly to the cleaning surface. Instructions for use of the cleaning system may preferably include pictures and/or words detailing preferred application pattern and dosing. As noted above, the preferred composition of this liquid is mild and minimizes harm to most surfaces.

In another embodiment, a volatile liquid is applied to a cleaning pad. If the cleaning pad 28 is premoistened the volatile liquid can be applied between 15 to 85% saturation. A preferred premoistened cleaning pad is 25% saturated with the volatile liquid.

As noted above, in the context of wet dusting, the cleaning solution can be distributed using the fluid reservoir 30. Optionally, for increased convenience, additional compositions can be delivered in the form of a pre-moistened cleaning pad 28.

Optionally, and most preferably, convenience and performance can be maximized by using a system composed of a disposable cleaning pad 28 as described hereinbefore. The pad can be composed of any one of the alternative cleaning pads 28 described above.

This cleaning system 22 and method of use provides multiple benefits versus conventional cleaning modes. It reduces time to clean or dust, because the cleaning pad retains a greater amount of dust and the preferred cleaning solution removes fingerprints smudges and other surface marks. It eliminates the need to carry a separate dusting or cleaning solution. Due to the high absorbency of the pad, especially when used in conjunction with the preferred cleaning solution, the pad absorbs and locks away dirt and dust, such that a single pad 28 can clean large surface areas.

Additionally, since a fresh pad 28 may be used every time, germs and dirt are trapped, removed and thrown away, promoting better hygiene. Conventional dusting tools, which are re-usable, can harbor dirt and germs, which can be spread throughout the household. Through operator-controlled dosing and more efficient removal of dirt and dust, a better end result is also achieved.

Additionally, because the cleaning process involves use of low levels of solution in contact with the surface to be cleaned for much shorter periods of time relative to conventional cleaning systems, (e.g. the multiple steps of applying a separate cleaning solution and grabbing a cleaning tool are combined in the present invention), the system and method provide improved surface safety on delicate surfaces.

The cleaning pads 28 are versatile in that they can be used for multiple cleanings and multiple surfaces. Each pad is designed to clean at least one average size surface with an average debris or dust load. Pads can be changed sooner if surfaces are larger than average, or especially dirty. To determine if the pad needs changing, the user may look at the back of the cleaning surface of the cleaning pad and ascertain if the cleaning surface is saturated with dust and/or dirt.

To maximize the synergy between the various cleaning, and dusting tasks, the present methods can be carried out using several varying executions and instructions for use. In one embodiment, the kit may be provided with multiple cleaning pads and/or solutions for different cleaning tasks. One solution and cleaning pad could be used for surface cleaning and another solution and pad for dusting. The kit may be sold separately via promotional materials, advertising and/or with instructions in each kit being used to explain the benefits of using the various products together. Promotional materials are defined in U.S. Pat. No. 6,777,064. This definition as well as the others discussed below found in that patent are incorporated herein by reference.

The promotional material, instructions and other pertinent information may be communicated to the user via a manner other than traditional printed methods including, but not limited to, multimedia presentations on CD-ROMs or DVDs included with the packaging, accessed via the internet by entering or scanning the product's UPC or trade name into an internet browser, by reading an imbedded RFID tag located within the cleaning implement with an electronic device, or through some other suitable electronic means. In this respect, a mutually beneficial interface between the user and the consumer goods provider may be created.

The cleaning implement of the present invention may also be useful for removing allergens from a surface. The definition of "allergens" may be found in U.S. Pat. No. 6,777,064. In one aspect, the cleaning implement comprises:

a handle; a removable cleaning cloth, preferably at least one nonwoven top sheet without strips or cuts and lower attached fiber bundle; and a spray container for use with the cloth.

The implement and, separately, the cleaning sheet of the present invention are designed to be compatible with all hard surface substrates, including wood, vinyl, linoleum, countertop materials, painted walls, floors, ceramic, porcelain, and the like.

The handle will preferably comprises a means to allow the cleaning cloth to be releasably attached. Any suitable means for attaching the cleaning sheet to the support head may be utilized, so long as the cleaning cloth remains affixed during the cleaning process. Examples of suitable fastening means include a support or head with clamps, hooks & loops, grooves, threads, bumps, tines, and the like. After release, the cloth is preferably conveniently removed and disposed of.

The present invention also relates to articles of manufacture that are useful for removing allergens from surfaces. The present articles typically comprise packages containing cleaning pads or cloths, such as those described hereinbefore, the packages being in association with information or instructions that will inform the consumer, by words and/or by graphics or pictures, that use of the cloths will provide cleaning benefits which include soil (e.g., allergens, dust, lint, etc.) removal and/or entrapment. This information typically also includes a claim of superiority over other cleaning products. Since many consumers are particularly sensitive to allergens, it is important that the information or instructions used in associated with the kit also has to the ability to convey the idea that the cleaning implement and/or pad removes allergens from surfaces, especially emphasizing the percentage of allergens removed from surfaces. The phrase "in association with" is defined in U.S. Pat. No. 6,777,064.

In one preferred embodiment, the package has information that informs the consumer that the use of the cleaning sheet provides significantly reduced levels of allergens, dust and other airborne matter in the atmosphere especially when used with a spray. The package in association with information preferably informs the consumer, by words, graphics, and/or by pictures, that use of the compositions will provide benefits such as reduction of allergens on surfaces, improved cleaning, reduction of airborne particles in the air, etc. The information can include, e.g., advertising in all of the usual media, as well as statements and icons on the package, or the cloth or implement itself, to inform the consumer.

Typically, the inventive cleaning pad remove between about 50% and 100% of the allergens, preferably at least about 80%, and more preferably at least about 95% of the allergens from a surface by wiping the surface with the cleaning pad. This amount of allergen removal can typically be achieved with only a single pass of the cleaning cloth or pad over the surface being cleaned. Information regarding the amount of allergen removal of the cleaning sheets can be important to consumers and motivate them to use the kit for allergen removal from surfaces.

The information provided can be further directed to specific allergens, since consumers can be sensitive to certain allergens, but not to others. Examples of allergens that can be picked up the inventive implement and to which consumers tend to be sensitive are included in U.S. Pat. No. 6,777,064 which are commonly found in the typical household environment.

It can be of further importance to provide information regarding the superior allergen removal ability of the present cloth compared to more traditional cleaning devices such as traditional dust mops or traditional brooms. Further, a statement regarding the electrostatic forces generated by the cleaning cloth, implement, and/or article of manufacture may be included, specifically with respect to the ability of such forces to remove allergens from surfaces.

Included in the instructions may be a claim that the cleaning cloth can be used by wiping a surface to remove allergens, as well as soil, dirt, dust, and the like. The information can further include an instruction to throw the present cleaning pad or cloth sheet away after it is used, such that the allergens collected on the pad are thrown away also and are thus removed from the consumer's living environment.

The information provided can also provide an instruction to wipe surfaces, especially walls, ceilings, ceiling fans, shelves, and the like, with the present cleaning pad, implement, and/or article. This information can be especially useful in association with packages containing the present kit or cleaning implement. This information can be provided in an electronic format as previously described.

One preferred implement of the present invention may further comprise an elongated handle to reach elevated surfaces. Also, when soil and dust is removed from elevated surfaces, the soil and dust are typically stirred up into the air, and the present cleaning pad is able to minimize this effect.

The information described herein can also be in association with packages containing the present cleaning implements as described herein.

Packages which are useful in the present invention for holding cleaning sheets include boxes, cartons, shrink-wrapped kits, flow wrap films, resealable film packages, resealable cartons, clamshell packs, plastic tubs, and the like. Preferred packages are reclosable cartons such as those described in U.S. application Ser. No. 09/374,715 filed Aug. 13, 1999 by Hardy, which is hereby incorporated by reference.

The present invention also includes a method of promoting the use and sale of the present cleaning sheets, implements, or articles of manufacture that are useful in removing allergens, preferably a large percentage of allergens, from a surface. The present methods also preferably comprise providing promotional materials to consumers by a variety of steps to inform them of the allergen removal benefits of the present cleaning sheets, implements, and articles. The promotional materials preferably comprise information, as described herein, regarding the allergen removal benefits of the present cleaning sheets, implements, and articles of manufacture.

The present methods are especially important to improve the health of consumers because with the present methods, consumers who otherwise might not use the cleaning cloths, implements, and/or articles of the present invention, especially consumers who suffer from allergies, will be informed of the allergen removal benefit of the present cleaning cloths and be motivated to use them to remove allergens from surfaces. This reduces the amount of allergens, as well as airborne particulates, in the environment around the consumer and relieves the consumer's allergic reactions, leading to a more healthy environment for the consumer.

In one embodiment, a typical method comprises a method of promoting the sale of a cleaning pad or cloth (preferably a hydroentangled nonwoven cleaning pad comprising an additive preferably selected from the group consisting of a wax, an oil, and mixtures thereof) and spray, useful for removing allergens from surfaces comprising the steps of (a) displaying, shelving, or merchandising a cleaning implement (preferably a nonwoven cleaning pad comprising an additive and a spray); and/or (b) providing promotional materials to consumers, wherein said promotional materials have information regarding ability to remove allergens from surfaces and/or an instruction to relieve allergy symptoms and/or remove allergens from surfaces by wiping a surface, preferably a household surface, with the cleaning pad.

In another embodiment, the method includes sending promotional materials directly to consumers via mail, e.g., regular mail or electronic mail. Preferably, consumers who receive such messages also suffer from allergy-related symptoms. The promotional materials can also include samples of the cleaning pads, implements, or articles and can preferably include discount coupons which the consumer can redeem upon purchasing the present cleaning pads, implements, or articles. Alternatively, promotional materials may be set to a health care professional so that such a professional may refer their patients to the present invention.

In another embodiment, the present method of promoting the sale of a cleaning sheet for removing allergens from a surface to a purchaser of an allergy-related product comprises the steps of (a) identifying the purchaser of an allergy-related product; and/or (b) providing promotional material to the purchaser, wherein the promotional material comprises information regarding the ability of the cleaning pad, implement, and/or article to remove allergens from a surface and/or a discount coupon redeemable upon purchase of said cleaning pad. The promotional material is preferably provided to the purchaser of the allergy-related product at the point-of-sale of the allergy-related product. Preferably, the purchaser of the allergy-related product is identified by as system, more preferably a computer system, for printing the promotional material (such as the information and/or discount coupon as described herein) in a store in response to the purchase of the allergy-related product. The system can be programmed such that the sale of the allergy-related product triggers the printing of the promotional material regarding the present cleaning pads, implements, and/or articles. Suitable systems for the present methods are described in more detail in U.S. Pat. No. 4,723,212 issued Feb. 2, 1988 to Mindrum et al.; U.S. Pat. No. 5,592,560 issued Jan. 7, 1997 to Deaton et al.; U.S. Pat. No. 5,687,322 issued Nov. 11, 1997 to Deaton et al.; U.S. Pat. No.

5,832,457 issued Nov. 3, 1998 to O'Brien et al.; each of which are hereby incorporated by reference in their entirety.

The methods of the present invention of promoting the sale of the present cleaning pads, sprays, implements, and/or articles of manufacture motivate consumers to use the present pads, sprays, implements, and articles by communicating their allergen-removal benefits. Without this information, consumers might not otherwise use the present cleaning pads, sprays, implements, or articles, thereby missing an opportunity to create a healthier environment.

FIG. 5 shows promotional material comprising a package 400 having multiple panels, including potentially an inside coupon panel or further instruction panel. The contents of the panels preferably include at least one of the following: instructions for applying fluid to the pad 402, instructions for using fluid and the pad to clean a surface 404, graphics illustrating how fluid may be applied to one of the pad and a surface 406; text or an illustration showing a spray bottle fitting in a channel in the handle 408; an indication that the kit contains components with fiber technology that traps and locks dust 410; instructions comprising putting liquid in a handle cradle, putting the pad on forks of the support, and cleaning using the liquid 412; text or graphics including a trademark or copyright symbol 414, recommendations regarding furniture care 416, an indication that the product is good for a variety of surfaces 418, use of words new 420, cleaning, polish, or wipe, recycling information 422, an Internet URL 424, a product bar code 426, a caution regarding product safety 428, information regarding the scent of the spray 430, and a reference to dust control 432. Other information 434 that may be included is as follows: Multi-surface spray boosts performance; Caution: Combustible liquid; Multisurface spray bottle contains about 1 fluid ounces or 25 mL; Dusters, cloths or pads are disposable; Refills are included; always make sure electronic equipment is turned off before using; do not spray and floors or bathtubs as it could leave them slippery; do not use duster with any other cleaning products or water; do not wash duster; do not use on hot surfaces, i.e., light bulbs; keep away from heat and flames; keep container closed; keep out of reach of children and pets; made in China; information on a question and comments helpline; information on patent protection; information on a customer service address; a statement that contained therein is at least one duster, one spray container, and one dusting pad; the product is "new"; the product is comparable to other leading brands; and the product is comparable to Pledge brand products.

It is understood that the component parts of the inventive system 20 described above may be manufactured and sold separately or together in the form of a cleaning system or kit. It should be further understood the present invention contemplates a variety of additional alternative configurations and component parts which may be attached within the pivot member-receiving cavity 50 of the handle portion 24. A wide variety of alternative interchangeable cleaning implements may be substituted for the cleaning pad support member 26 described above.

The alternative cleaning implements would preferably include a support member with a modular design which includes a universal pivot member or other attachment member similar to that described in the preferred embodiment such that the alternative implements could be used interchangeably with the preferred handle portion 24.

Furthermore, although the preferred embodiment illustrates a handle portion 24 pivotally attached to a cleaning pad support 26, it is recognized that the present invention is in no way limited to such a construction. For example, the inventive cleaning system 20 could be constructed as a single non-movable piece allowing only surface spraying of the cleaning fluid. Likewise, the cleaning pad support need not be pivotally attached to the handle portion as described in the preferred embodiment. Numerous alternative embodiments that allow for movement of the cleaning pad support 26 in relation to the handle portion are within the scope of the invention. The cleaning pad support member 26 and handle portion 24 may alternatively be slidably connected, hingedly connected, bendable or otherwise movable into its various desired orientations. See, e.g., U.S. Pat. No. 5,953,784. A spring loaded lock switch could be used to allow 180° rotation of the cleaning pad support member 26. The cleaning pad support member 26 could include a centrally located pivot member to allow for 360° rotation. Alternatively, the handle portion could be rotatable 360° in relation to the cleaning pad support member 26. Additionally, the handle portion 24 could include an integral or attachable telescoping extension to allow for dusting or cleaning areas outside of a normal user's reach.

Additionally, the handle portion as described could be eliminated completely and the fluid reservoir could be arranged to form the handle of the cleaning system. The pivotable attachment member could be attached to the upper end of the fluid reservoir. Further, although the spray bottle described herein is a physically separate module, it will be manifest that the spray bottle may be directly integrated into, or form the handle portion with which it is associated. The reservoir could have a plug that could be removed when filling with fluid.

The cleaning pad support could alternatively be connected to the handle portion via a threaded connection. Such an orientation would allow for the ease of attachment and removal of the numerous alternative cleaning implements that are within the scope of the present invention. The cleaning pad support could also be alternatively arranged to rotate in either a vertical or horizontal direction to accommodate various cleaning functions. The cleaning system could further include a motorized spinning head for additional efficacy and less effort on behalf of the consumer.

Although the cleaning fluid delivery system has been described in reference to the fluid reservoir, it is recognized that alternative configurations for delivering cleaning fluid to a surface to be cleaned or to a cleaning media are also within the scope of the present invention. For example, the fluid reservoir could be arranged in a manner such the cleaning fluid is sprayed or applied on the back surface of a cleaning pad or cloth and allowed to move through the cloth via a wicking action. Alternatively, the attachment members or tines 108*a*, 108*b* of the cleaning system could be in fluid communication with the cleaning fluid reservoir such that cleaning fluid may be discharged on a cleaning pad 28 via the attachment members 108*a*, 108*b*. Such a delivery system could deliver cleaning fluid through the tip, bottom, top or lateral sides of the attachment members. Alternatively, the liquid delivery system could include a flip out nozzle or reservoir configured for spraying cleaning fluid onto the cleaning media. Such a configuration would eliminate the need for a pivoting support member.

Although the best mode contemplated by the inventors of carrying out the present invention is disclosed above, practice of the present invention is not limited thereto. It will be manifest that various additions, modifications and rearrangements of the features of the present invention may be made without deviating from the spirit and scope of the underlying inventive concept.

Moreover, as noted throughout the application the individual components need not be formed in the disclosed shapes, or assembled in the disclosed configuration, but could be provided in virtually any shape, and assembled in virtually any configuration, so as to provide for a cleaning system that includes a cleaning fluid reservoir attached to cleaning implement support. Furthermore, all the disclosed features of each disclosed embodiment can be combined with, or substituted for, the disclosed features of every other disclosed embodiment except where such features are mutually exclusive.

It is intended that the appended claims cover all such additions, modifications and rearrangements. Expedient embodiments of the present invention are differentiated by the appended claims.

The invention claimed is:

1. A cleaning kit including a cleaning article comprising:

a fusible base sheet;

a fusible holding sheet;

a fiber bundle layer including fusible fibers at least in part, wherein the fiber bundle layer is attached to one side of the base sheet and the holding sheet is bonded to the other side of the base sheet along a central along a central bonding line and spot bonding regions, wherein the central bonding line and spot bonding regions cooperate to form two holding spaces between the retaining sheet and the base sheet, wherein the base sheet, the fiber bundle layer and the holding sheet are bonded in a direction to cross fibers in the fiber bundle layer;

and a holder configured to be received within the holding spaces, wherein the holding spaces are provided between the base sheet and the holding sheet and wherein the holder is detachably inserted into the holding spaces;

wherein a first set of fibers in the fiber bundle includes fibers attached to the base sheet at only one location along the respective lengths of the fibers in the first set;

wherein a second set of fibers in the fiber bundle includes fibers attached to the base sheet at a plurality of locations along the respective lengths of the fibers in the second set; and wherein the first set of fibers and the second set of fibers are interspersed along length of the base sheet.

2. The cleaning kit of claim 1, wherein the base sheet has an outer edge that is rectangular and that is defined by a straight uncut upper edge, a straight uncut lower edge and two straight, uncut side edges.

3. The cleaning kit of claim 1, wherein the holder comprises;

a) a handle portion having an opening configured to allow access to a cradle; and b) a cleaning article support member moveably attached to the handle portion.

4. The cleaning kit of claim 1, further comprising a container for the kit.

5. A cleaning kit including:

a cleaning article having a brush portion, comprising;

a first fusible sheet and a second fusible sheet that provide two holding spaces into which a holder is to be inserted; and a fiber bundle layer including fusible fibers, the fiber bundle layer being bonded to the first fusible sheet to provide a brush portion that is composed of the fusible sheets and fibers of the fiber bundle layer, wherein the fibers of the fiber bundle layer have a free movement length defined between a free end of a respective fiber and a location where the respective fiber is bonded to the first fusible sheet, and wherein the fiber bundle comprises a first set of fibers bonded at only one location along the respective lengths of the fibers, the fibers of the first set having free movement lengths that are greater than the free movement lengths of fibers in a second set of fibers, and wherein the first set of fibers and the second set of fibers are irregularly interspersed along a length of the first fusible sheet.

6. The cleaning kit of claim 5, where the cleaning article further comprises:

a handle defining an interior recess:

a cleaning article support having a pair of parallel laterally extending attachment prongs having a plurality of projections extending generally perpendicularly from the prongs, the cleaning article support being rotatably attached to the handle.

7. The cleaning kit of claim 6, wherein the cleaning article support comprises a pivot member at one end, the pivot member including a plurality of indentations configured to receive a semi-flexible engagement tab projecting downward from the handle.

8. The cleaning kit of claim 6, further comprising a detachable cleaning fluid dispenser within the interior recess.

9. The cleaning kit of claim 5, wherein the fibers in the first set are bonded to the first fusible sheet only by a central bonding line and wherein the fibers in the second set are bonded to the first fusible sheet by a bond positioned between the central bonding line and an edge of the first fusible sheet.

10. The cleaning kit of claim 9, wherein the bond positioned between the bonding line and an edge of the first fusible sheet comprises a plurality of spaced-apart spot bonds.

11. The cleaning kit of claim 10, wherein the second set of fibers comprises groupings of fibers, each grouping being bonded by one of the plurality of spot bonds, and wherein the groupings are interspersed among the first set of fibers.

12. The cleaning kit of claim 5, further comprising a container for the kit,

13. The cleaning kit of claim 12, wherein the container comprises packaging that contains the kit, wherein the packaging includes instructions for using the cleaning pad in conjunction with a fluid, and wherein the packaging includes an image of a spray bottle.

14. The cleaning kit of claim 5, wherein the first set of fibers is bonded by a central bonding line and wherein the second set of fibers is bonded by a plurality of spaced-apart spot bonds.

15. A cleaning kit including:

a cleaning article having a brush portion, comprising;

a first fusible sheet and a second fusible sheet that provide two holding spaces into which a holder is to be inserted;

a fiber bundle layer including fusible fibers at least in part, wherein the fiber bundle layer is attached to one side of the base sheet and the holding sheet is attached to the other side of the base sheet along a central bonding line and spot bonding regions, wherein the central bonding line and spot bonding regions cooperate to form two holding spaces between the retaining sheet and the base sheet, wherein the base sheet, the fiber bundle layer, and the holding sheet are bonded in a direction to cross fibers in the fiber bundle layer;

a holder configured to be received within the holding spaces, wherein the holding spaces are provided between the base sheet and the holding sheet, and wherein the holder is detachably inserted into the holding spaces;

wherein the fibers of the fiber bundle layer have a free movement length defined between a flee end of a respective fiber and a location where the respective fiber is bonded to the first fusible sheet;

wherein the fiber bundle comprises a first set of fibers bonded at only one location along the respective lengths of the fibers, the fibers of the first set having free movement lengths that are greater than the free movement lengths of fibers in a second set of fibers, and wherein the first set of fibers and the second set of fibers are irregularly interspersed along a length of the first fusible sheet.

* * * * *